US005439316A

United States Patent [19]

Richardson

[11] Patent Number: 5,439,316

[45] Date of Patent: Aug. 8, 1995

[54] PORTABLE REUSABLE FLOOD BARRIER PANEL SYSTEM

[76] Inventor: Cecil A. Richardson, 105 Gardenia Ct., Upland, Calif. 91786

[21] Appl. No.: 282,201

[22] Filed: Jul. 28, 1994

[51] Int. Cl.[6] ..... E02B 7/02; E02D 31/00

[52] U.S. Cl. ..... 405/114; 405/21; 405/91

[58] Field of Search ..... 405/114, 115, 91, 29-35; 52/462, 396.04, 396.05

[56] References Cited

U.S. PATENT DOCUMENTS

| | | | |
|---|---|---|---|
| 492,704 | 2/1893 | Anderton . | |
| 1,898,095 | 2/1933 | Noetzil . | |
| 1,902,741 | 3/1933 | Weber | 405/114 X |
| 2,407,952 | 9/1946 | Del Castillo . | |
| 2,515,059 | 7/1950 | Rowbotham . | |
| 2,566,748 | 9/1951 | Ringrose . | |
| 2,580,034 | 12/1951 | Lyons | 52/396.05 X |
| 2,961,731 | 11/1960 | Buzzell et al. | 405/114 X |
| 3,581,450 | 6/1971 | Patry | 52/396.04 X |
| 4,111,583 | 9/1978 | Brady et al. | 52/396.05 X |
| 4,307,974 | 12/1981 | George | 52/396.04 X |
| 4,375,929 | 3/1983 | Clark | 405/114 |
| 5,118,217 | 6/1992 | Younes . | |

*Primary Examiner*—Dennis L. Taylor

*Attorney, Agent, or Firm*—Denton L. Anderson; Sheldon & Mak

[57] ABSTRACT

A reusable flood barrier is provided to erect reusable flood barrier banks. The flood barrier comprises (a) a front panel having a front face, a rear face, a top edge, a pair of side edges, and a base; (b) a rear support attached to the rear face of the front panel to prop the front panel on the base; and (c) an elongated clamp removably and adjustably affixed to the front face of the front panel. The clamp has an edge disposed proximate and substantially parallel to each side edge of the front panel respectively. The clamp is capable of anchoring a long edge of an elongated interconnection gasket. The gasket is capable of placement over the gap between a side edge of the front panel of a first flood barrier and an abutting side edge of the front panel of an adjacent flood barrier. The anchoring action of the clamp on adjacent flood barrier front panels enables the gasket to provide a water seal between the front panels.

15 Claims, 25 Drawing Sheets

OPTION "A" STANDARD CONCRETE
WEIGHT 2368#
GROUND LOAD 431#/ SQ. FT.

OPTION "B" HYDROLITE CONCRETE
WEIGHT 1888#
GROUND LOAD 344#/ SQ. FT.

OPTION "C" RIDGELITE CONCRETE
WEIGHT 1488#
GROUND LOAD 271#/ SQ. FT.

SCALE: 1" = 2"

(1) REMOVE GASKETS
FOR STORAGE

① REMOVE GASKETS FOR STORAGE

FLOOD BARRIER STACKING SYSTEM

FLOOD BARRIER STACKING METHODS (1) REMOVE INTERCONNECT GASKET FOR STORAGE (2) CRIB STYLE STACKING (3) 18 UNITS STORED IN 64 SQ. FT.

1 REMOVE INTERCONNECT GASKET FOR STORAGE
2 FLAT STACKING ON 4x4 TIMBERS
3 20 UNITS STORED ON 32 SQ. FT.

9"
15'
OUTSIDE STORAGE OF 3' OR 4' STEEL BARRIERS
GROUND LEVEL
1
2
3

(1) REMOVE INTERCONNECT GASKET FOR STORAGE (2) 30 UNITS STORED ON 37 SQ. FT.

(3) 4 x 4 TIMBERS

PORTABLE REUSABLE FLOOD BARRIER PANEL SYSTEM

BACKGROUND

Floods are responsible for severe damage to hundreds of public and private properties every year, causing millions of dollars in economical damage. Floods also displace a vast number of people and threaten lives.

The most common method of flood control is to have hundreds of people fill and deploy thousands of sandbags. A problem with this method is that it requires untold hours of labor and often the time required for erecting an effective flood barrier is too long and the floods inevitably take over. A further problem with sandbag barriers is that they leak.

Yet another problem with sandbag barriers is the labor intensive task of removing them after the flood has receded and disposing them in dump sites. Sandbags are not recyclable and pose environmental pollution since present plastic thread woven bags used for sandbags will last for years in the dump sites.

In some instances flood barrier systems consisting of several individual flood barrier units located side by side in horizontal alignment have been used instead of sandbags. However, a problem with such systems is that the individual flood barriers require heavy machinery to transport and deploy them at flood sites. If the flood site consists of rough ground, most transportation vehicles cannot even reach the deployment site. Since existing flood barrier units are not man-portable, their usefulness is reduced.

Where floods are severe, higher flood barrier banks must be erected. A problem with existing flood barrier systems is that higher flood barrier banks require higher individual flood barrier units. For example, a nine foot high flood barrier bank requires individual flood barrier units nine foot high. Such immense flood barrier units are very difficult to transport and deploy.

A further problem with existing flood barrier systems is that flood barrier units of several different heights must be kept in stock, each barrier height corresponding to a flood barrier bank of that height as necessitated by the severity of flood conditions.

Another problem with existing flood barrier systems is their non-adaptability to worsening flood conditions. A flood barrier bank of a certain height deployed to obstruct floods of certain strength can be quickly overflowed if flood water levels rise. Since time is of the essence, building a higher flood barrier bank behind an overflowed flood barrier bank is impractical.

Yet a further problem with existing flood barrier systems is leakage. Current methods of closing the gaps between adjacent flood barrier units are ineffectual, leading to leakage of flood waters and resulting property damage. The leakage problem is made worse where adjacent flood barrier units are misaligned due to ground conditions, or where the flood barrier bank turns a corner.

Thus there is a need for a flood barrier system which is portable, reusable, quickly deployable. There is also a need for such a system to allow for erecting barriers in layers to meet the ultimate flood height.

SUMMARY

The invention satisfies these needs.

The invention provides a flood barrier comprising: (a) a front panel having a front face, a rear face, a top edge, a pair of side edges, and a base; (b) a rear support attached to the rear face of the front panel to prop the front panel on the base; and (c) an elongated clamp removably and adjustably affixed to the front face of the front panel, the clamp having an edge disposed proximate and substantially parallel to each side edge of the front panel respectively. The clamp is capable of anchoring a long edge of an elongated interconnection gasket. The gasket is capable of placement over the gap between a side edge of the front panel of a first flood barrier and an abutting side edge of the front panel of an adjacent second flood barrier. The anchoring action of the clamp on adjacent flood barrier front panels enables the gasket to provide a water seal between the front panels.

In a preferred embodiment of the invention the rear support comprises a rear panel having a top edge, side edges, and a base. The top edge of the rear panel is affixed to the rear face of the front panel such that the rear panel is transverse to the front panel. The top edge of the rear panel is substantially parallel to the top edge of the front panel, and the side edges of the rear panel do not extend beyond the side edges of the front panel.

In another preferred embodiment of the invention the front face and the rear face of the front panel of the flood barrier further comprise at least one stake pocket respectively, each stake pocket being capable of receiving a foundation stake protruding into the stake pocket uprightly. The flood barrier also comprises at least two foundation stakes capable of being planted in the ground, whereby the front panel can be disposed on the base with each foundation stake introduced into a respective stake pocket. In this embodiment, the rear support comprises at least one elongated rear vertical brace capable of being planted in the ground, whereby the front panel can be supported on the base with the rear vertical brace abutting the rear face of the front panel.

In another embodiment of the invention the flood barrier further comprises at least one stacking support affixed to the rear face of the front panel to allow stacking a portion of a second flood barrier on top of the flood barrier to form a higher flood barrier bank. The front panel of the second flood barrier is disposed in parallel with the front panel of said flood barrier so as to substantially seal their interface.

The stacking support can comprise an arm affixed to the rear face of the front panel proximate the top edge of the front panel. In one embodiment of the invention the arm can support a portion of a second flood barrier comprising (a) a front panel having a front face, a rear face, a pair of side edges, and a base, and (b) a rear support affixed to the rear face of the front panel. The rear support comprises at least one elongated telescopic leg with a top end and a base end where the top end of the leg is affixed to the rear face of the front panel proximate the top edge of the front panel.

In another embodiment of the invention the arm can support a portion of a second flood barrier comprising (a) a front panel having a front face, a rear face, a pair of side edges, and a base, and (b) a rear support affixed to the rear face of the front panel comprising a rear panel to prop the front panel on the base. The rear panel has a top edge, side edges, and a base. The top edge of the rear panel is affixed to the rear face of the front panel such that the rear panel is transverse to the front panel. The top edge of the rear panel is substantially parallel to the top edge of the front panel, and the side edges of the rear panel do not extend beyond the side edges of the front panel.

The present invention provides for erecting a flood barrier bank comprising (a) a plurality of flood barriers according to the present invention, the flood barriers being located side-by-side in substantially horizontal alignment; and (b) a plurality of elongated interconnection gaskets placed over the gap between a side edge of the front panel of a first flood barrier and an abutting side edge of the front panel of an adjacent second flood barrier to provide a water seal between the front panels of the adjacent flood barriers.

DRAWINGS

These and other features, aspects and advantages of the present invention will become understood with reference to the following description, appended claims and accompanying drawings where:

DESCRIPTION

Figure 1:
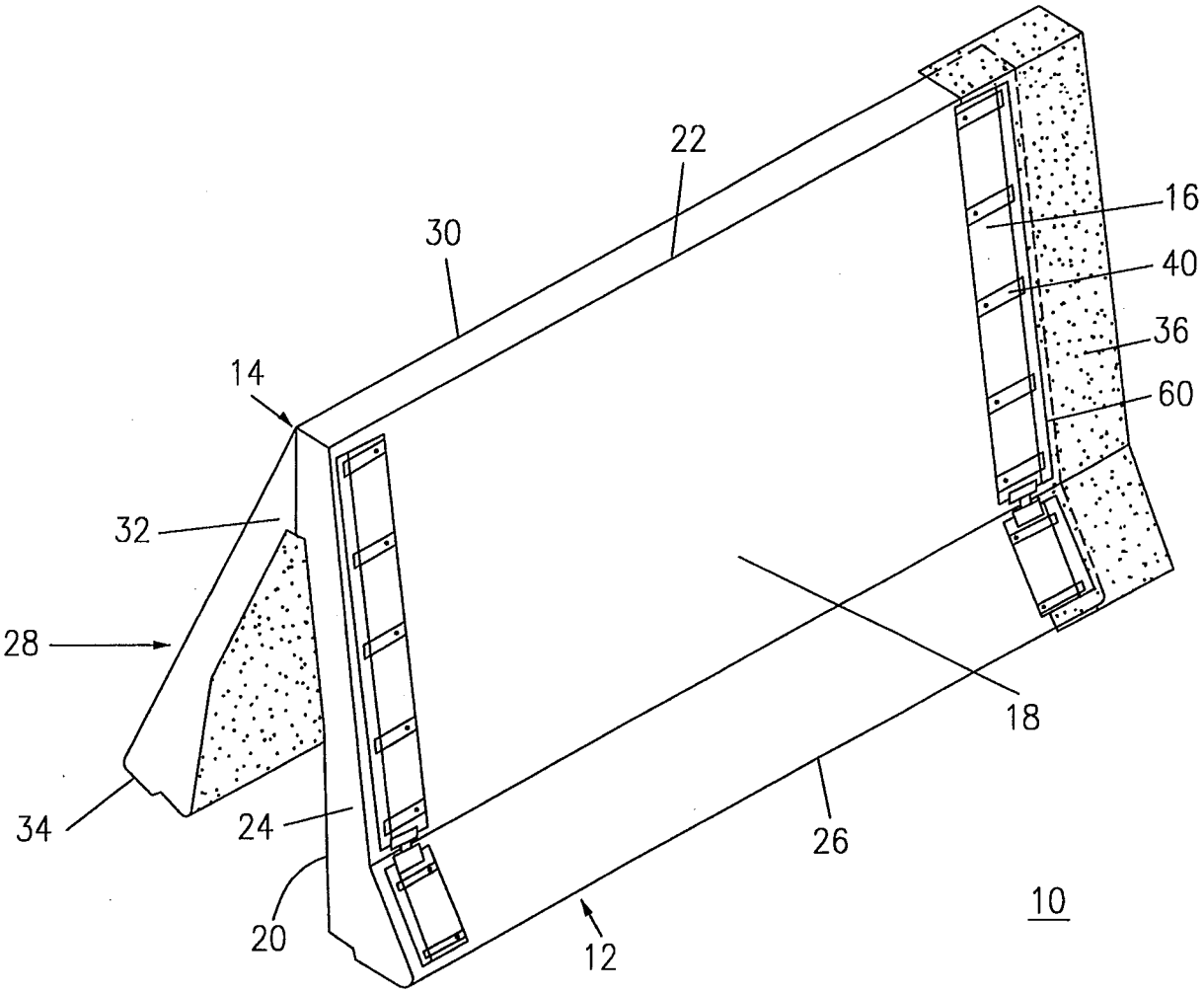
FIG. 1 is a perspective view of a flood barrier embodying features of the invention.

Referring to the drawings, a flood barrier 10 embodying features of the invention comprises (a) a front panel 12; (b) a rear support 14; and (c) an elongated clamp The front panel 12 comprises a front face 18, a rear face 20, a top edge 22, a pair of side edges 24, and a base 26. The front panel 12 can be manufactured from watertight non-erodible rigid materials such as reinforced concrete or steel.

The rear support 14 is attached to the rear face 20 of the front panel 12 to prop the front panel 12 on the base 26. In an embodiment of the invention, shown in FIG. 1, the rear support 14 comprises a rear panel 28 having a top edge 30, side edges 32, and a base 34. The top edge 30 of the rear panel 28 is affixed to the rear face 20 of the front panel 12 such that the rear panel 28 is transverse to the front panel 12. The top edge 30 of the rear panel 28 is substantially parallel to the top edge 22 of the front panel 12, and the side edges 32 of the rear panel 28 do not extend beyond the side edges 24 of the front panel 12. In this embodiment, both the front panel 12 and the rear panel 28 are manufactured from rigid materials such as reinforced concrete or steel.

Figure 5:
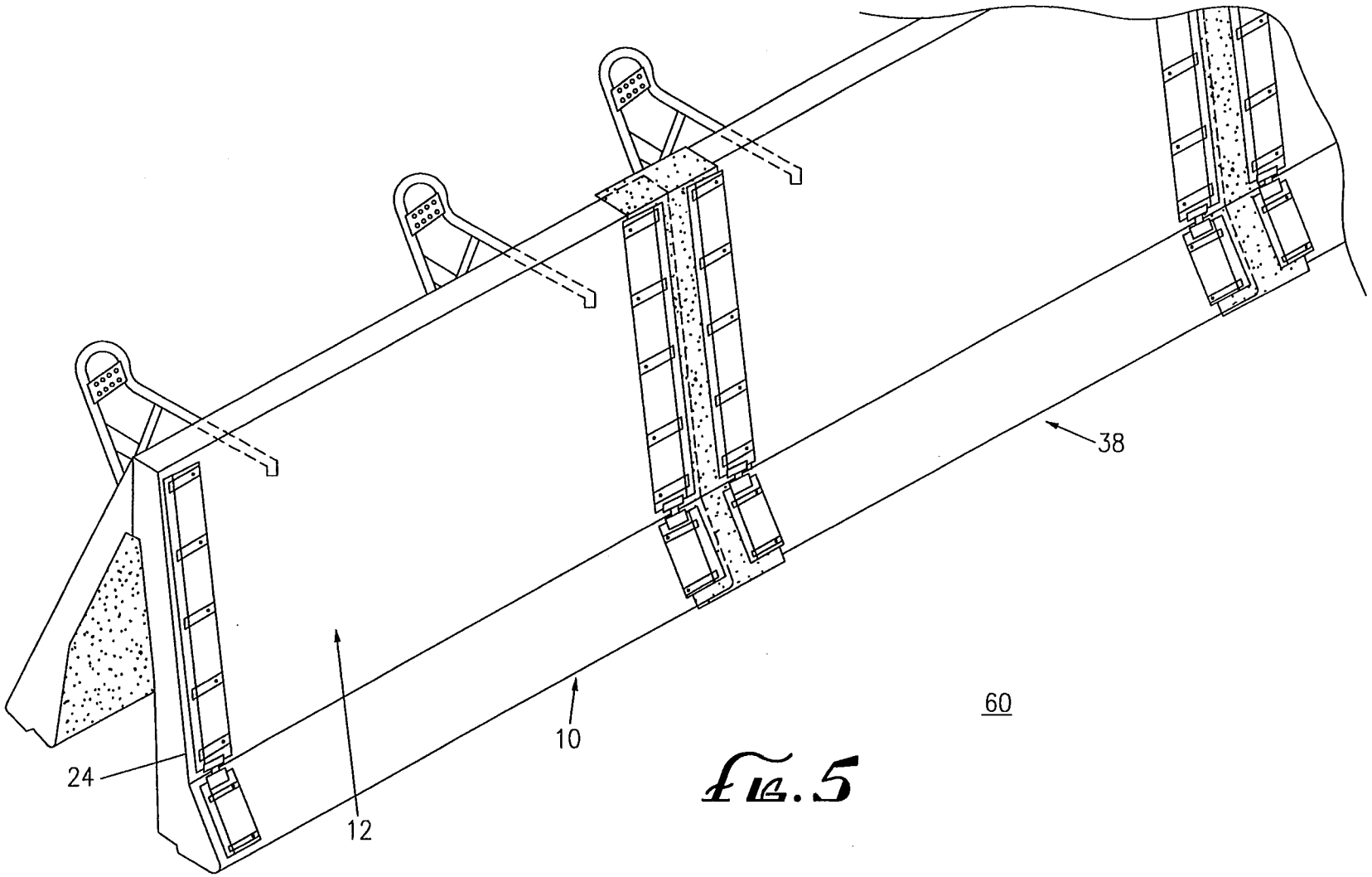
FIG. 5 is a perspective view of interconnected flood barriers according to the present invention.

The clamp 16 is removably and adjustably affixed to the front face 18 of the front panel 12. The clamp 16 has an edge 60 disposed proximate and substantially parallel to each side edge 24 of the front panel 12 respectively. The clamp 16 is capable of anchoring a long edge of an elongated interconnection gasket 36, the gasket 36 being capable of placement over the gap between a side edge 24 of the front panel 12 of a first flood barrier 16 and an abutting side edge 24 of the front panel 12 of an adjacent second flood barrier 38 as shown in FIG. 5.

The anchoring action of the clamp 16 on adjacent flood barrier front panels 12 enables the gasket 36 to provide a water seal between the front panels 12. The clamp 16 can be manufactured from rigid materials such as steel, aluminum, or hard plastics.

In the embodiment of the invention shown in FIG. 1, the flood barrier 10 comprises a pair of elongated clamps 16 removably and adjustably affixed to the front face 18 of the front panel 12. Each clamp 16 is disposed proximate and substantially parallel to each side edge 24 of the front panel 12 respectively. The clamps 16 further include holes 40 aligned along the length of each clamp 16 to allow bolting the clamps 16 to the front panel 12 of the flood barrier 10. The interconnection gasket 36 shown in FIG. 1 is made from a flexible water resistent material,such as rubber, and is at least of the same length as the side edges 24 of the front panel 12.

Figure 2:
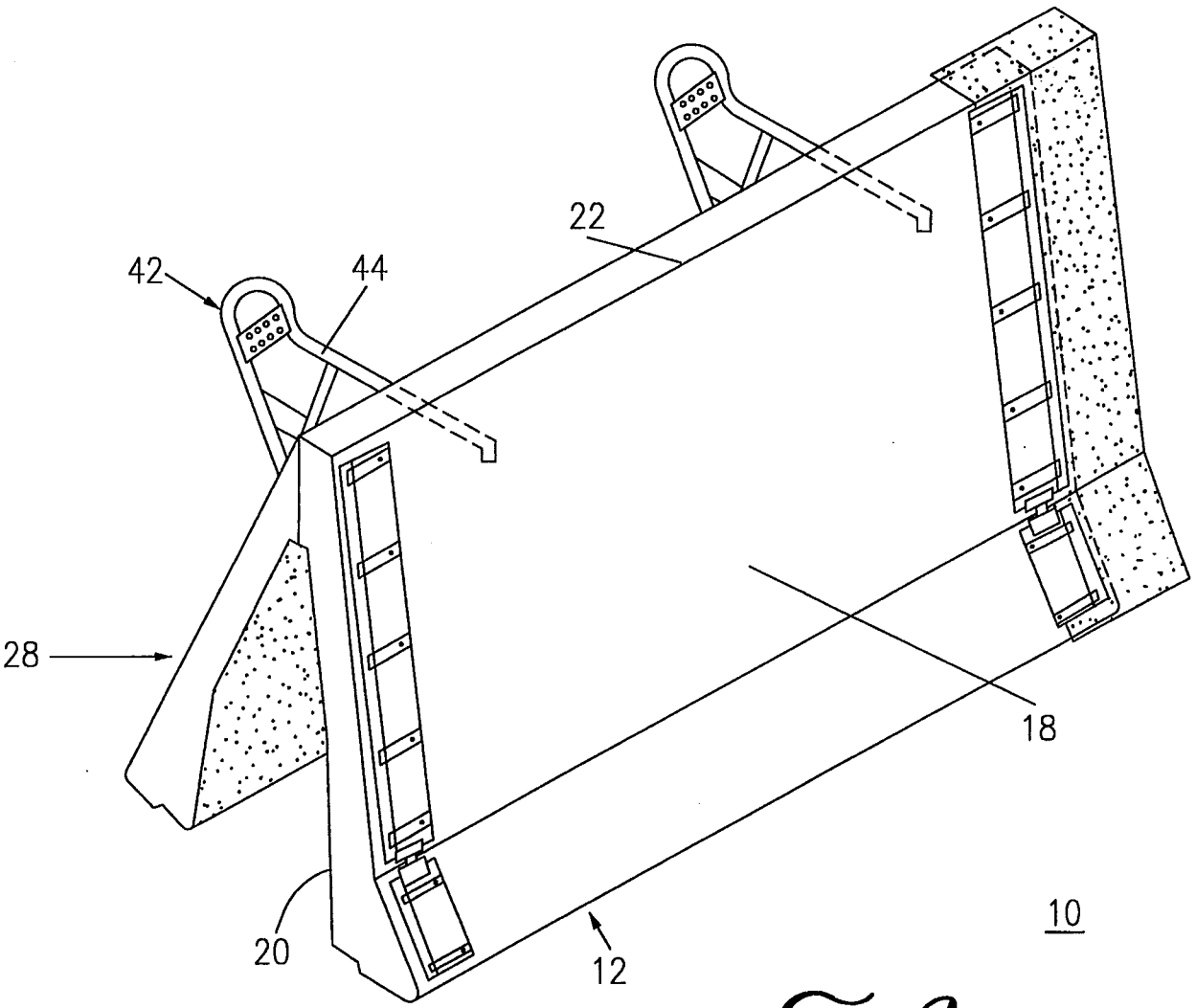
FIG. 2 is a perspective view of an embodiment of the invention with rear stacking supports.
Figure 4:
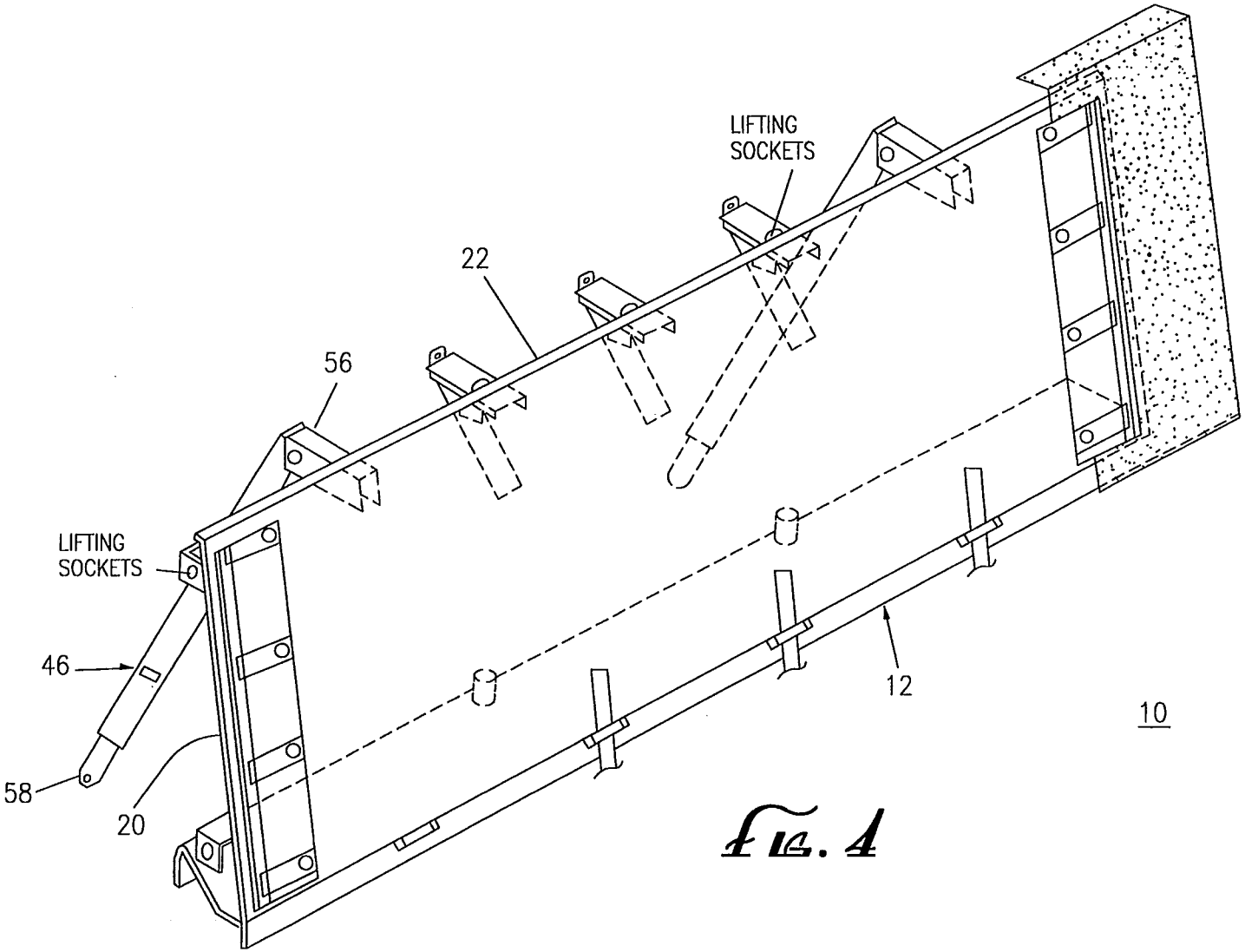
FIG. 4 is a perspective view of an embodiment of the invention with rear leg supports.
Figure 6:
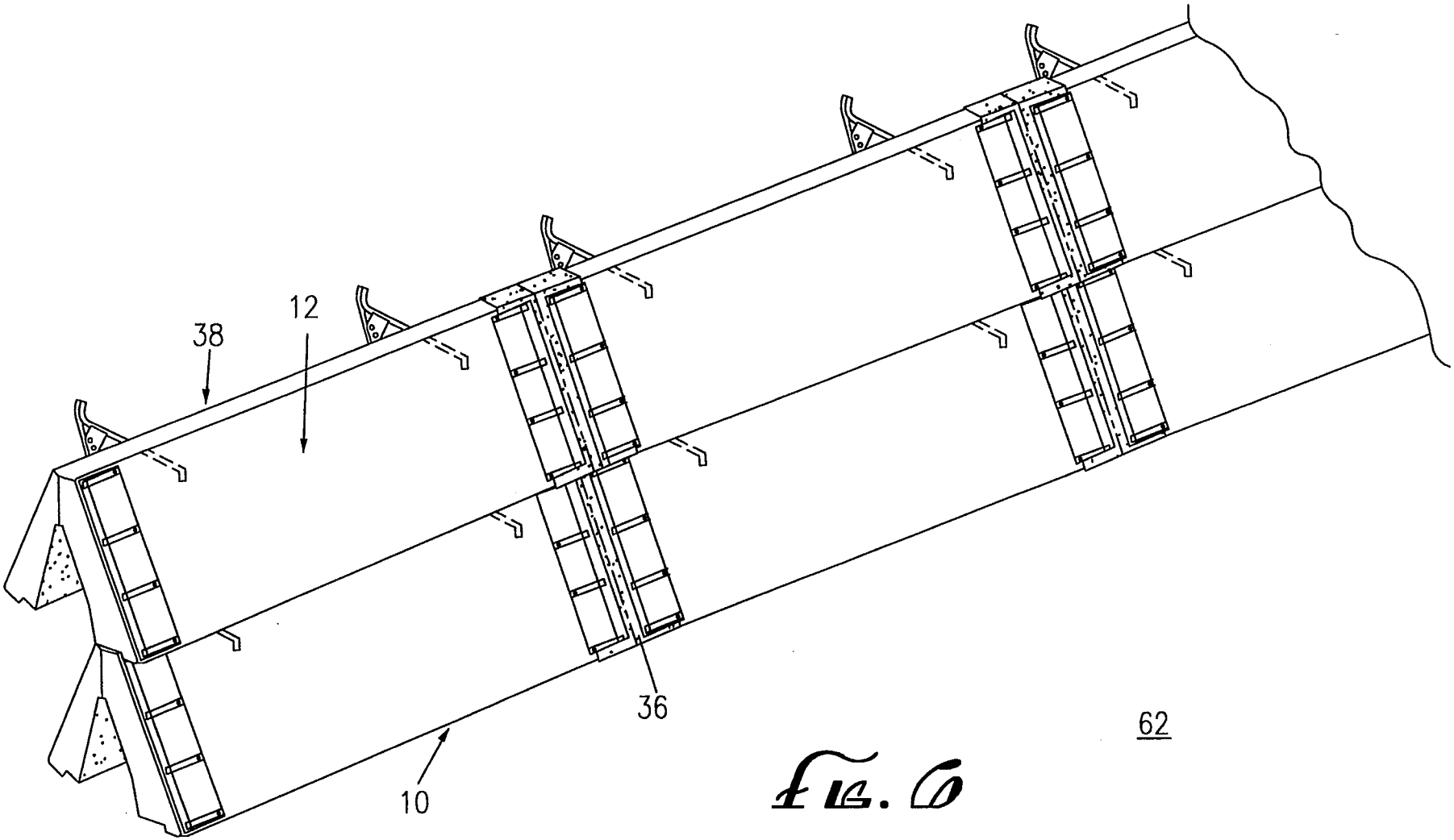
FIG. 6 is a perspective view of interconnected and stacked flood barriers according to the present invention.

In another embodiment of the invention, shown in FIG. 2, the flood barrier 10 can include at least one stacking support 42 attached to the rear face 20 of the front panel 12 to allow stacking a portion of a second flood barrier 38 on top of said flood barrier 10 to form a higher flood barrier bank as shown in FIG. 6. The front panel 12 of the second flood barrier 38 is disposed in parallel with the front panel 12 of said flood barrier 10 so as to substantially seal their interface. The stacking support 42 can comprise an arm 44 attached to the rear face 20 of the front panel 12 proximate the top edge 22 of the front panel 12. The arm 44 can support a second flood barrier 38 comprising (a) a front panel 12 having a front face 18, a rear face 20, and a base 26, and (b) a rear panel 28 affixed to the rear face 20 of the front panel 12 to prop the front panel 12 on the base 26 as shown in FIG. 6. The arm 44 can also be made to support a second flood barrier 38 comprising (a) a front panel 12 having a front face 18, a rear face 20, and a base 26, and (b) at least one elongated telescopic leg 46 affixed to the rear face 20 of the front panel 12 proximate the top edge 22 of the front panel 12 as shown in FIG. 4. The arm 44 can be made from any rigid materials such as steel or reinforced concrete. As shown in FIG. 2, a pair of stacking arms 44 can be affixed to the rear panel 28 proximate the top edge 30 of the rear panel 28.

Figure 3:
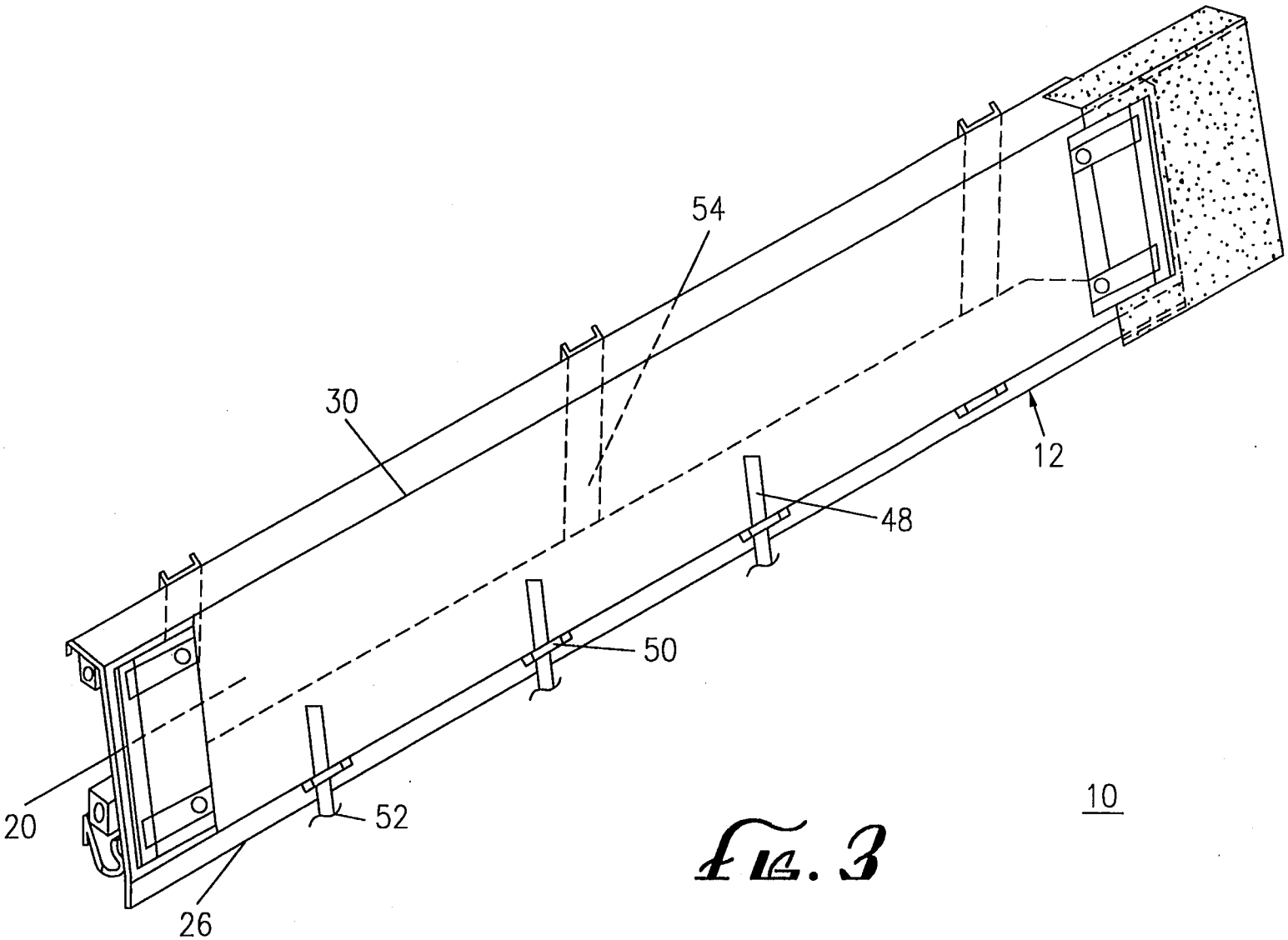
FIG. 3 is a perspective view of an embodiment of the invention with rear vertical braces.

In another embodiment of the invention, shown in FIG. 3, the front face 18 and the rear face 20 of the front panel 12 of the flood barrier 10 comprise at least one stake pocket 50 respectively, each stake pocket 50 being capable of receiving a foundation stake 48 protruding into the stake pocket 50 uprightly. The flood barrier 10 also has at least two foundation stakes 48 capable of being planted in the ground 52, whereby the front panel 12 can be disposed on the base 26 with each foundation stake 48 introduced into a stake pocket 50 respectively. In another embodiment of the invention, either only the front face 18 or only the rear face 20 of the front panel 12 have stake pockets 50. The rear support 14 comprises at least one elongated rear vertical brace 54 capable of being planted in the ground, whereby the front panel 12 can be supported on the base 26 with the rear vertical brace 54 abutting the rear face 20 of the front panel 12. The stakes are standard metal stakes used by building contractors to retain wooden concrete forms. The vertical braces 54 can be manufactured from steel or other rigid materials. Typically, at least two vertical braces 54, and at least two foundation stakes 48 are utilized. As shown in FIG. 4, instead of the vertical brace 54, an elongated telescopic leg 46 having a top end 56 and a base 58 can be used. The top end 56 of the leg 46 is affixed to the rear face 20 of the front panel 12 proximate the top edge 22 of the front panel 12, such that the leg 46 is transverse to the plane of the front panel 12. The leg 46 can be manufactured from steel or other rigid materials such as hard plastics.

As shown in FIG. 5, the present invention provides for erecting a flood barrier bank 60 comprising (a) a plurality of flood barriers 10 according to the present invention, the flood barriers 10 being located side-by-side in substantially horizontal alignment, and (b) a plurality of elongated interconnection gaskets 36 placed over the gap between a side edge 24 of the front panel 12 of the first flood barrier 10 and an abutting side edge 24 of the front panel 12 of an adjacent second flood barrier 38. The interconnection gasket 36 provides a water seal between the front panels 12 of adjacent flood barriers. The individual flood barriers 10 can be any one of the embodiments of the invention described above, but preferably adjacent flood barrier units 10 in a flood barrier bank 60 are of the same embodiment. The adjacent flood barrier units 10 are interconnected by placing the elongated interconnection gaskets 36 over the gap between a side edge 24 of the front panel 12 of one flood barrier 10 and an abutting side edge 24 of the front panel 12 of the other flood barrier 38 and anchoring the interconnection gasket 36 via the clamps 16 on the flood barriers so as to provide a water seal between the front panels 12 of the interconnected flood barriers.

The present invention also provides for erecting a stacked flood barrier bank 62, shown in FIG. 6, by disposing another set of flood barrier units side-by-side in substantially horizontal alignment on top of an interconnected set of flood barriers. The front panel 12 of each mounting flood barrier unit 38 is disposed in parallel with the front panel 12 of a corresponding mounted flood barrier unit 10 so as to substantially seal their interface. Each pair of stacked adjacent flood barriers are interconnected with an interconnection gasket 36 as described above.

EXAMPLES

Figure 7:
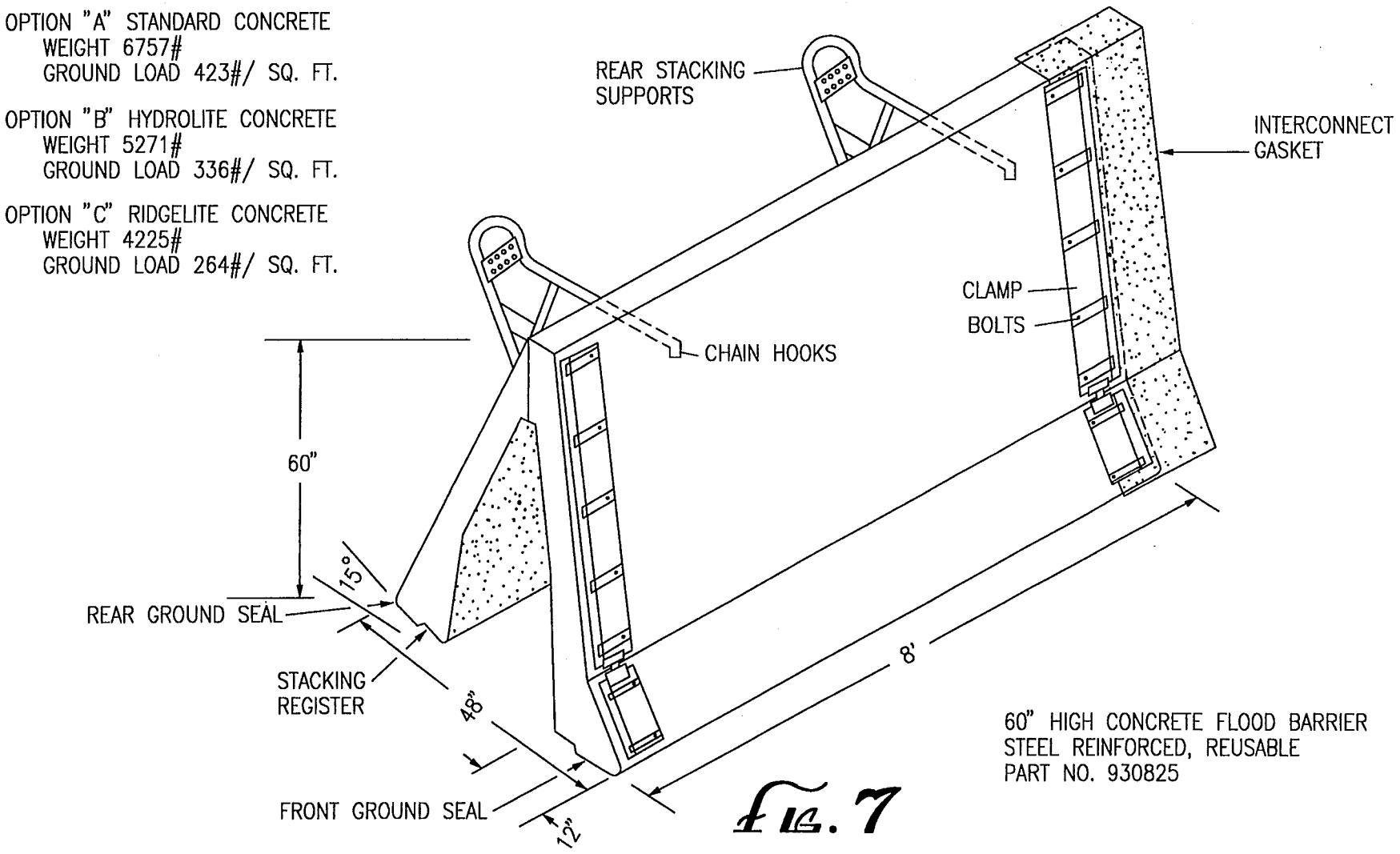
FIG. 7 is a perspective view of an example concrete flood barrier 60 inches high according to the present invention.
Figure 8:
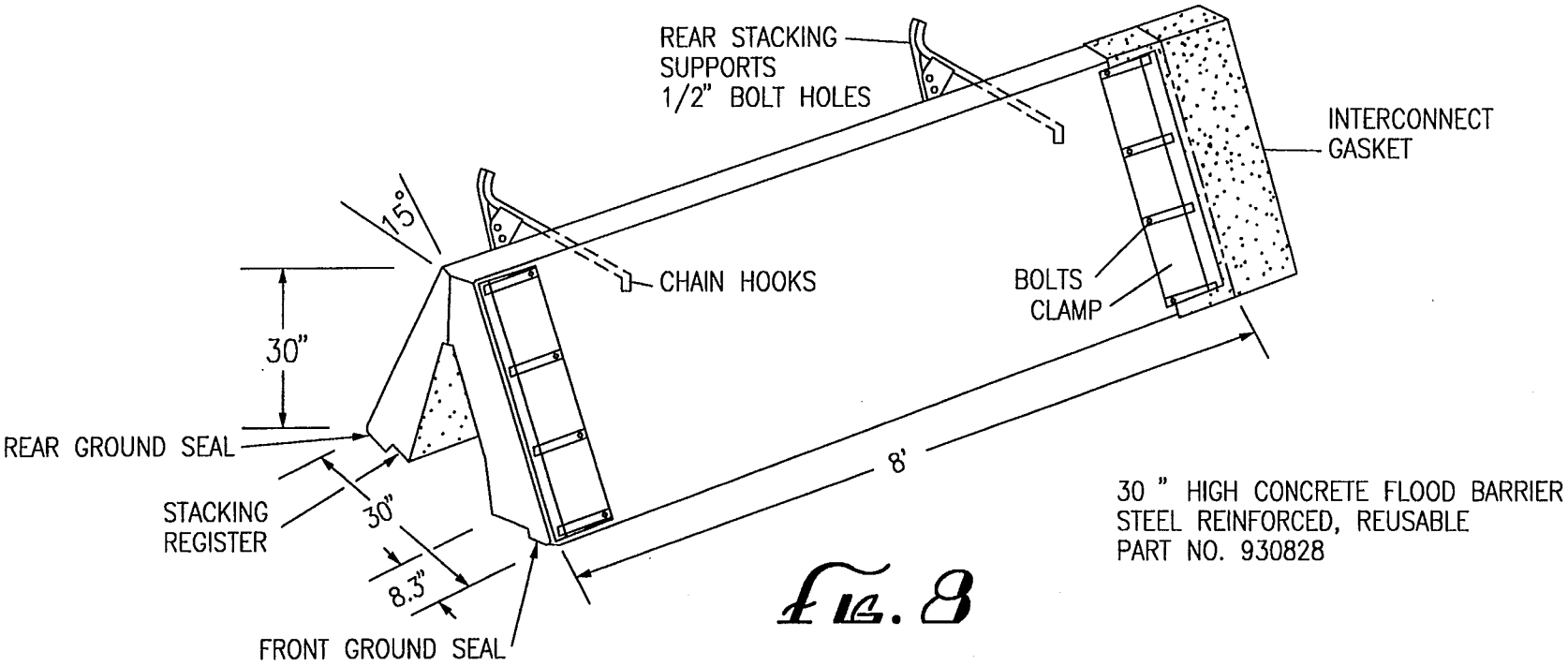
FIG. 8 is a perspective view of an example concrete flood barrier 30 inches high according to the present invention.

Illustrations of examples of the present invention are shown in FIGS. 7–25. The dimensions of a preferred embodiment of the invention are depicted in FIG. 7. The front and rear panels are made from concrete reinforced with steel bars. In this embodiment both the front and the rear panels are 60 inches high and 8 feet long. In a variation of this embodiment shown in FIG. 8 the panels are 30 inches high. These two example barriers are for extremely heavy currents and mud flows.

Figure 9:
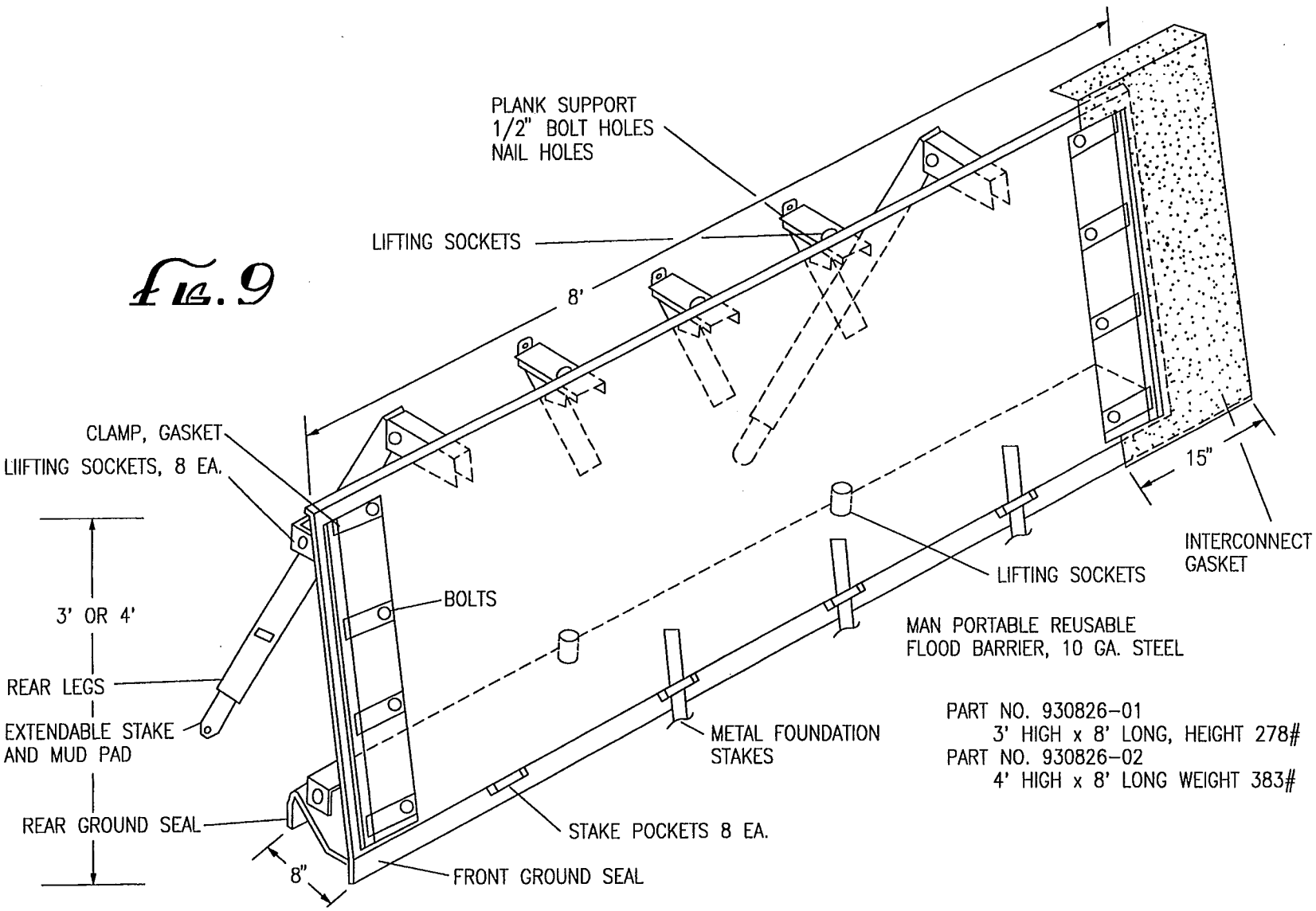
FIG. 9 is a perspective view of an example steel flood barrier 3 or 4 feet high and 8 feet long according to the present invention.

Another example of the invention is shown in FIG. 9, where the front panel is made from sheet steel 8 feet long. Variations of this embodiment can have heights of 18 inches, 35 inches, and 47 inches. The example flood barrier shown in FIG. 9 is three or four feet high. The flood barrier has a pair of rear telescopic legs for supporting the front panel. In addition, the flood barrier has four metal stakes front and back, and corresponding stake pockets on the front and rear faces of the front panel. The stakes are standard metal stakes used by building contractors to retain wooden concrete forms. These stakes are made from steel, $\frac{3}{8}$ inches thick, $1\frac{1}{2}$ inches wide, and 18 inches long. The interconnection gasket used with this flood barrier is 15 inches wide and at least three to four feet long. These steel barriers are man-portable over rough ground. Each man is provided with a 32 inch long piece of 1 inch galvanized pipe, which are threaded into "lifting sockets" to allow 4, 6, or 8 people to carry the panel to a required location.

Figure 10:
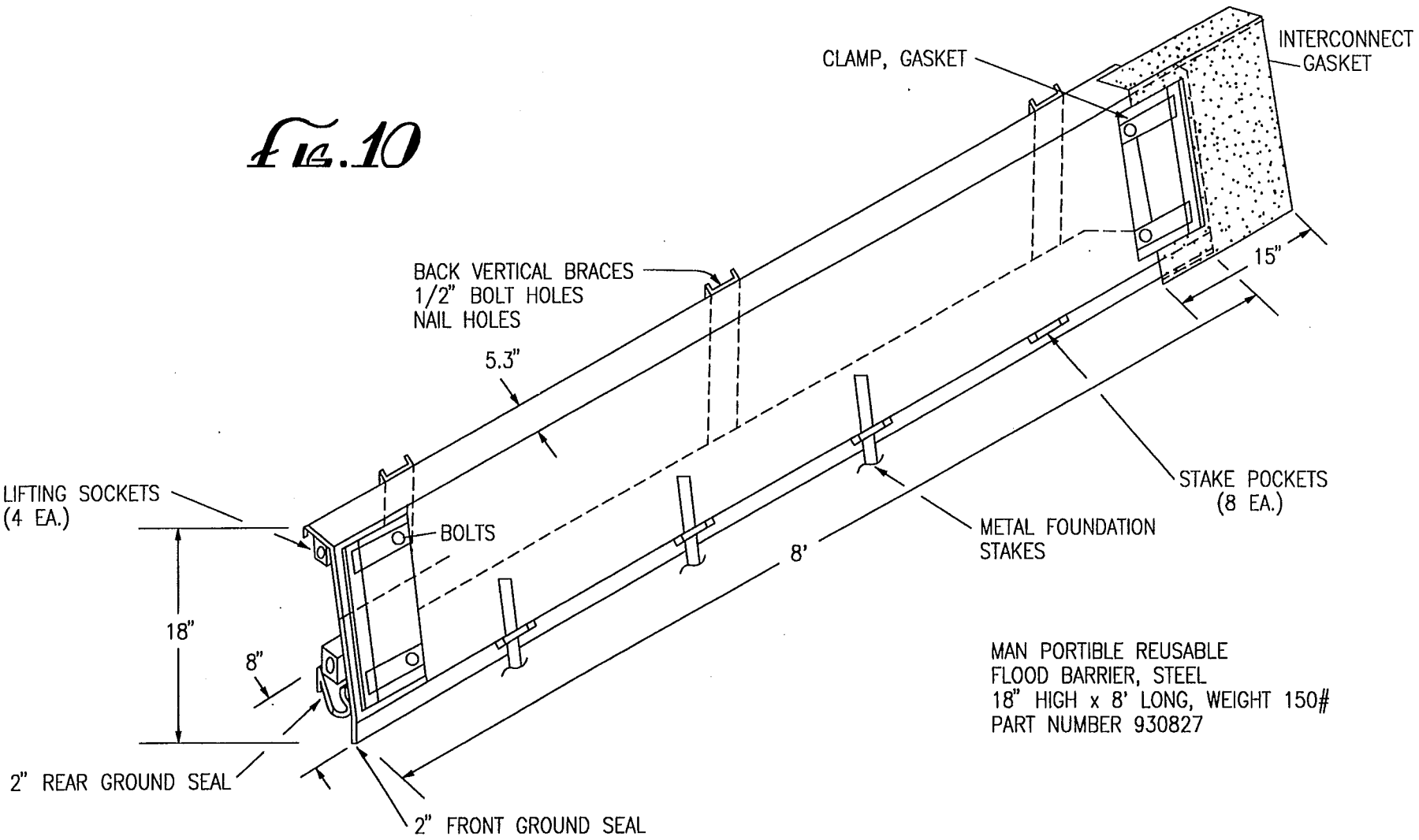
FIG. 10 is a perspective view of an example steel flood barrier 18 inches high according to the present invention.

In another example of the invention, shown in FIG. 10, the flood barrier has back vertical braces capable of being planted in the ground, whereby the front panel can be supported on the base with the rear vertical braces abutting the rear face of the front panel. The front panel is made from sheet steel 18 inches high and 8 feet long.

Figure 11:
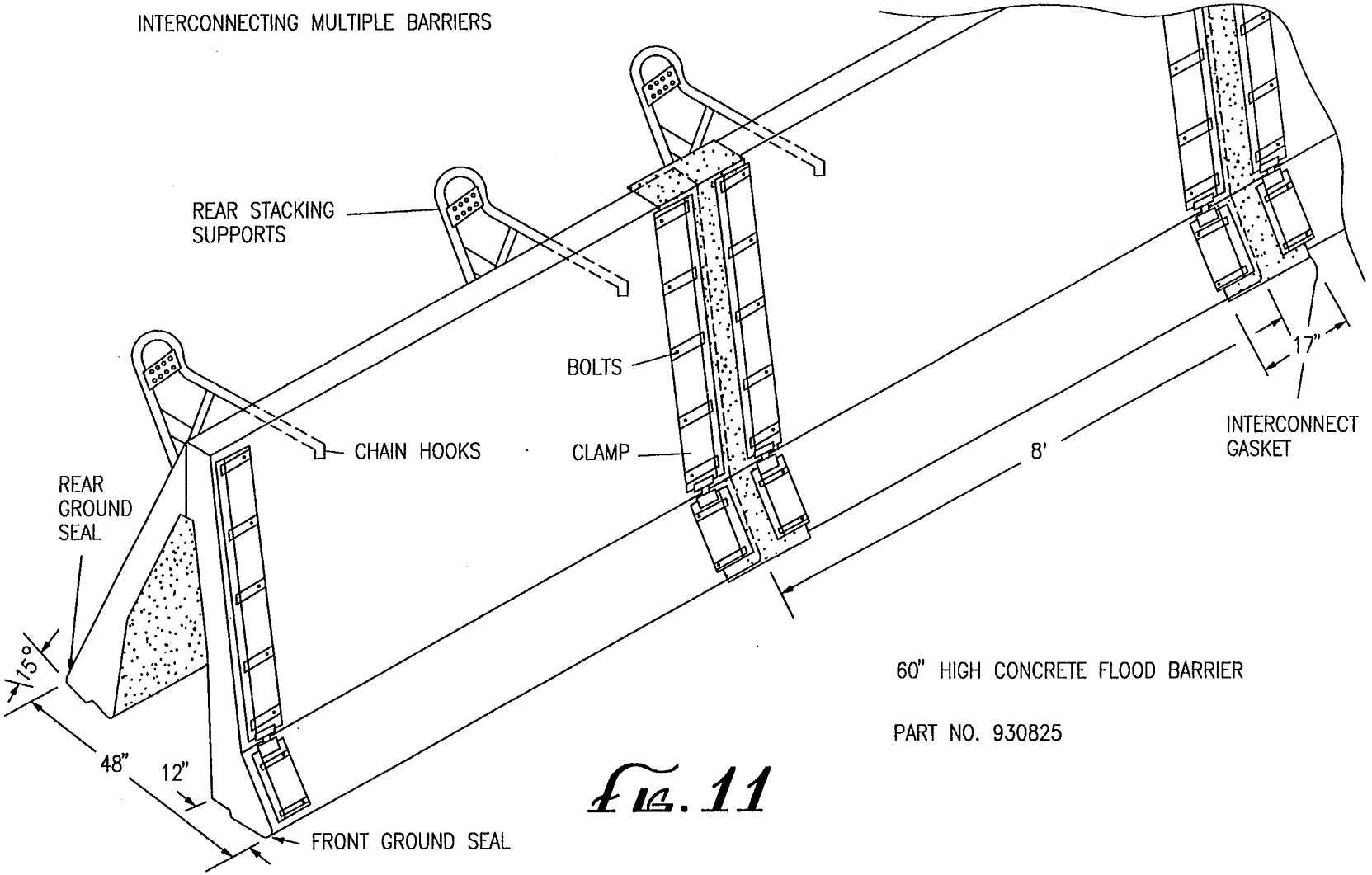
FIG. 11 is a perspective view of an example flood barrier bank comprising an interconnected set of concrete flood barriers 60 inches high and 8 feet long according to the present invention.
Figure 12:
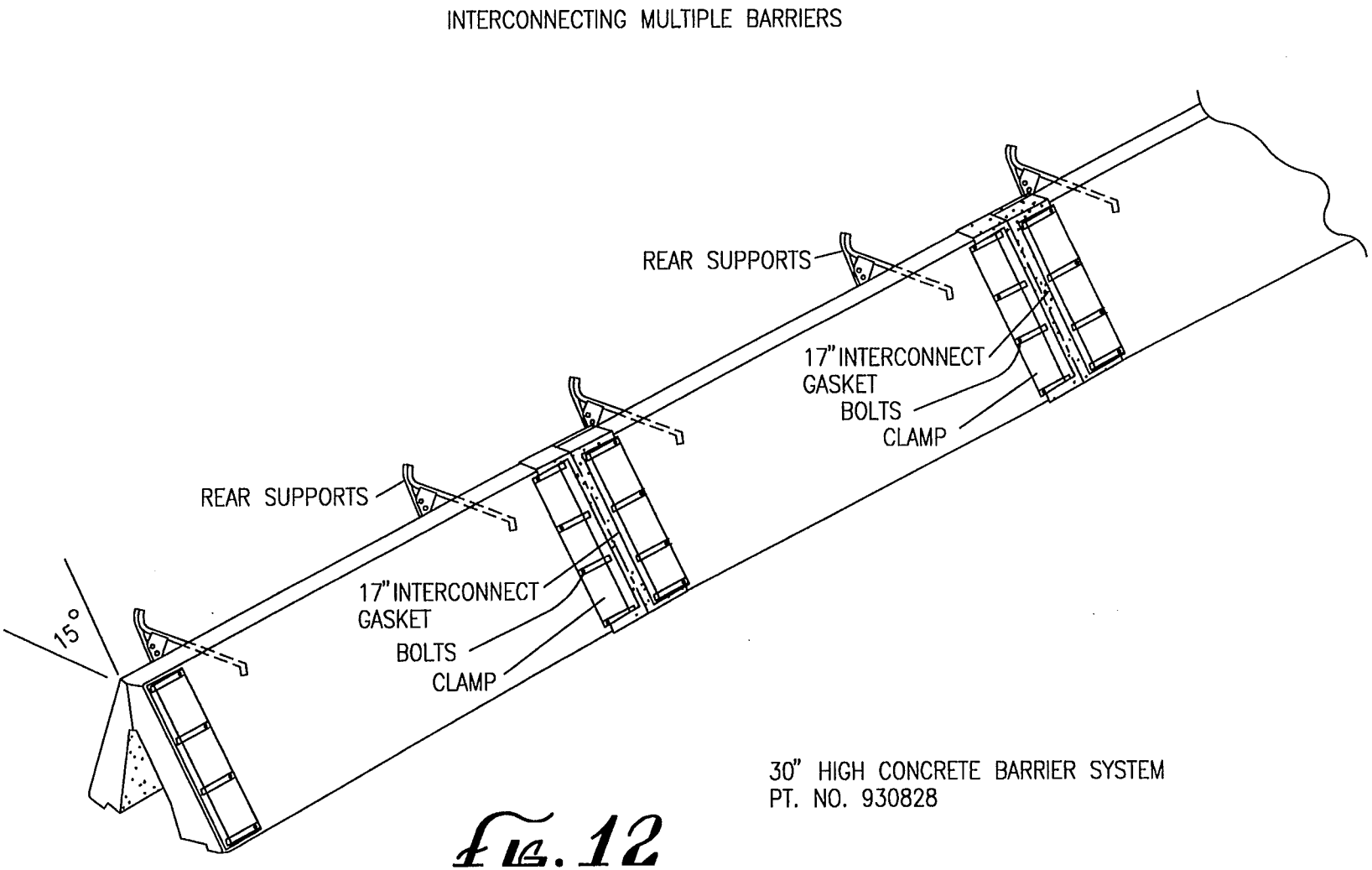
FIG. 12 is a perspective view of an example flood barrier bank comprising an interconnected set of concrete flood barriers is 30 inches high according to the present invention.

Referring to FIG. 11, a flood barrier bank comprising an interconnected set of flood barriers is shown. In this example the flood barriers are 60 inches high, 8 feet long and made from reinforced concrete. The interconnection gaskets are 17 inches wide and at least 60 inches long. Referring to FIG. 12 an interconnected set of flood barriers is shown wherein each flood barrier is 30 inches high. In this example the flood barriers are made from reinforced concrete.

To assemble the flood barriers into a continuous barrier, the interconnection gaskets are placed on the ground at 8 feel intervals. The flood barrier front panels are placed side-by-side with no more than 9 inches of space between them. Bolts are loosened or removed from the clamps to allow the interconnection gaskets to be folded up over the panels with the gasket edges under the clamps on adjacent flood barriers. The clamps are then tightened to provide a water seal between the panels.

Prior to disposing the flood barriers, some ground preparation in necessary to eliminate holes or bumps that can prohibit proper ground seal between the ground seals of the front panels of the flood barriers and the ground. In the embodiments of the invention where each flood barrier has a rear panel, ground preparation achieves proper ground seal with the rear panel as well. A soft surface that allows the sealing surface or the base of the flood barrier panels to sink into the ground provides a good seal. In addition, ground seal with the rear panel of the flood barrier can be reinforced by back filling dirt along the length of the flood barrier. The ground preparation can be done with power equipment or by hand. The steel barrier sealing edges are only 8 inches apart, and so require only a very narrow strip to be prepared. The concrete flood barriers have a wide base, but the ground preparation need only be for the footprint area i.e. two 12 inch strips for the 60 inch high units, or two 9 inch strips for the 30 inch units.

Figure 13:
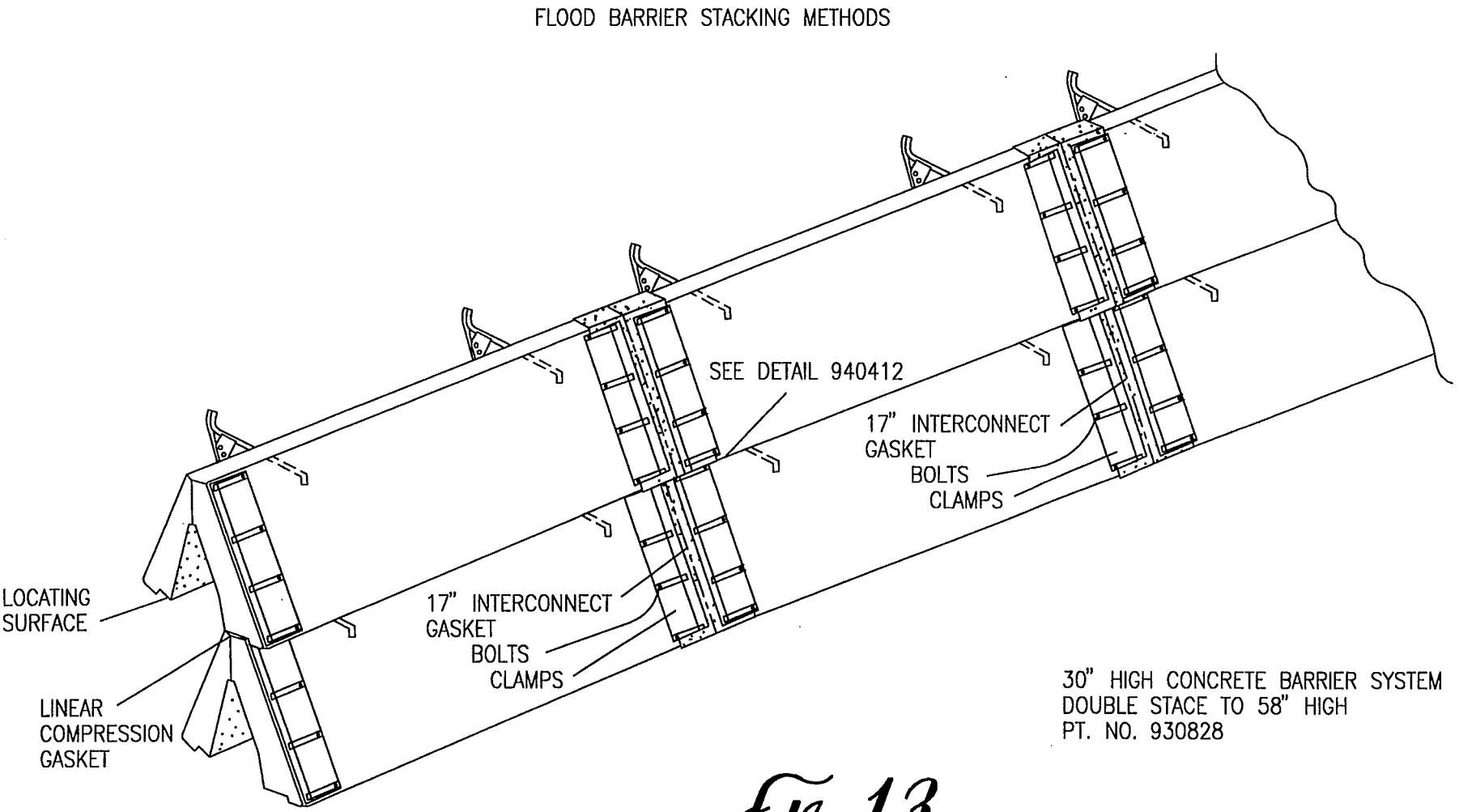
FIG. 13 is a perspective view of an example of a flood barrier bank 58 inches high and erected by stacking concrete flood barriers 30 inches high according to the present invention.
Figure 14:
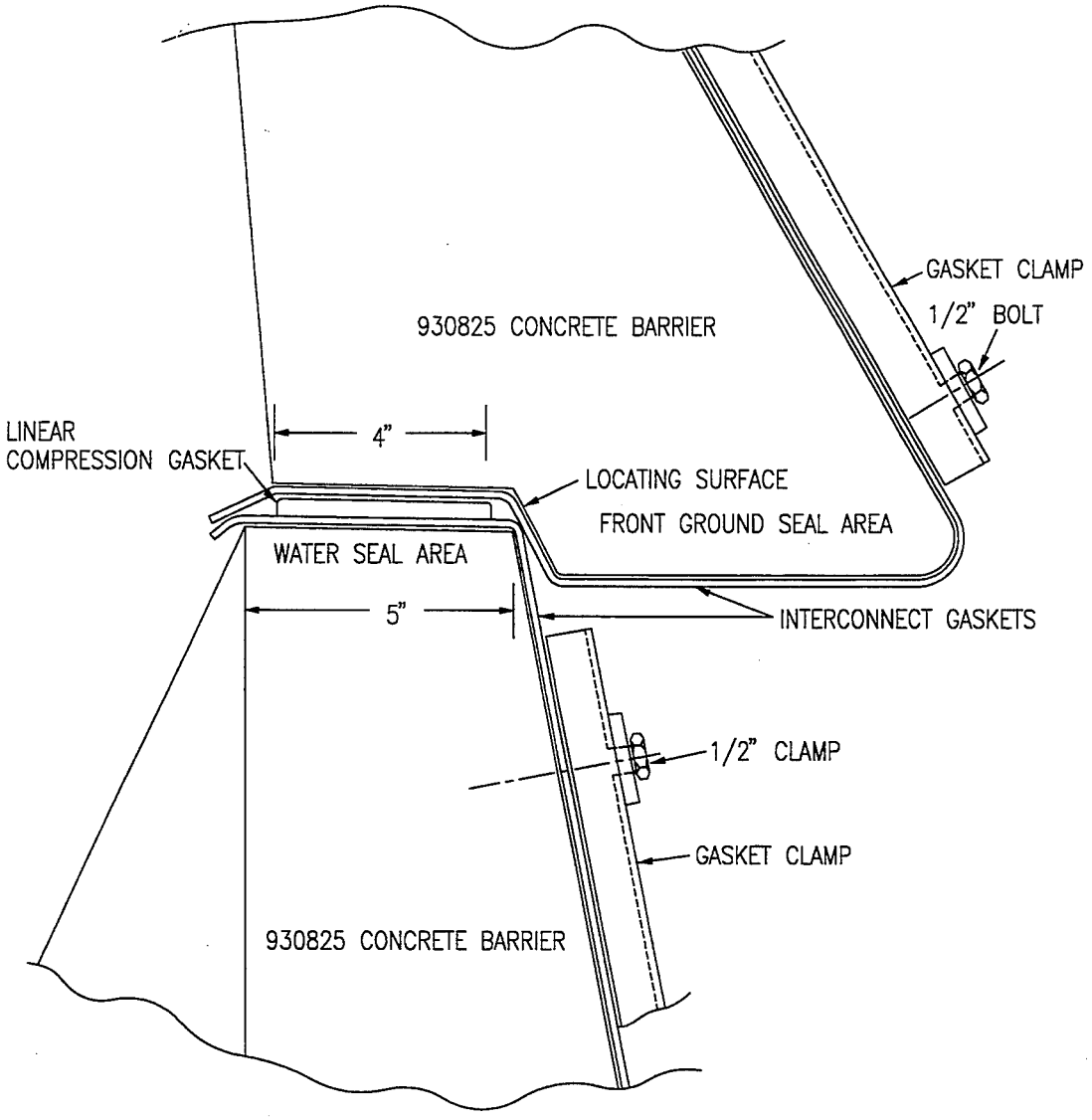
FIG. 14 is a side elevation view of an example water seal area is formed between stacking concrete flood barriers according to the present invention.
Figure 15:
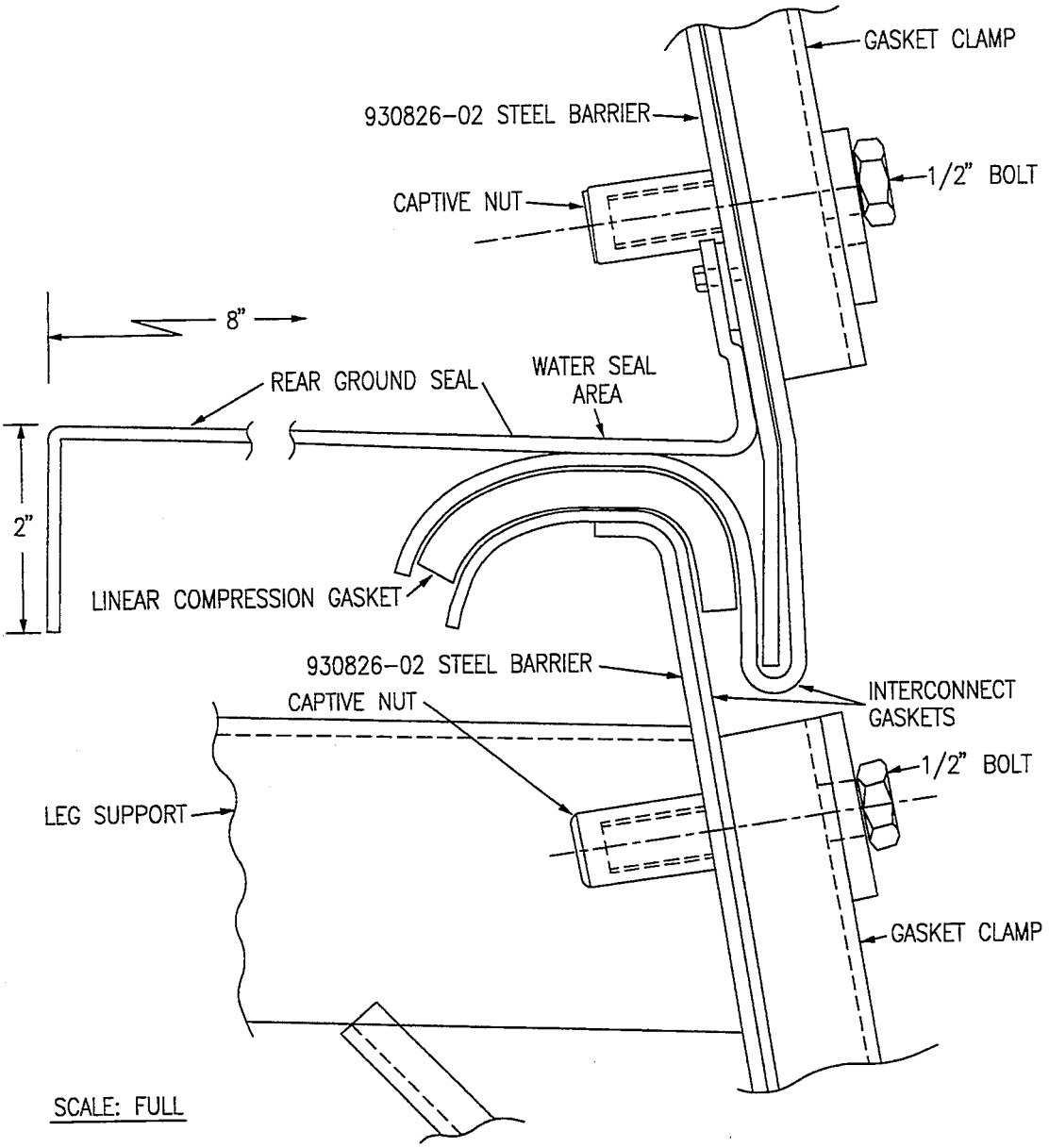
FIG. 15 is a side elevation view of an example water seal area is formed between stacking steel flood barriers according to the present invention.

Referring to FIG. 13, an example of a flood bank erected by stacking flood barriers is shown. In this example, 30 inch high concrete flood barriers are stacked to form a flood barrier bank 58 inches high. The base of the front panel of the mounting flood barriers are placed on top of the top edge of the front panel of the mounted flood barriers. The rear panels of the mounting flood barriers are supported by the stacking supports of the mounted flood barriers. Adjacent flood barriers in each row are interconnected with 17 inch wide interconnection gaskets. A linear compression gasket is placed between the base of the front panel of a mounting flood barrier and the top edge of the front panel of the mounted flood barrier to form a water seal. FIG. 14 shows an example of the details of the water seal area for mounting and mounted concrete flood barriers. As shown in FIG. 14 the bottom edge of the interconnection gasket of a mounting flood barrier is folded underneath the base of the front panel of the flood barrier, and the top edge of the interconnection gasket of a mounted flood barrier is folded over the top edge of the front panel of the flood barrier. A linear compression gasket is placed between the two folded edges of the interconnection gaskets wherein the weight of the mounting flood barrier compresses the compression gasket onto the top edge of the front panel of the mounted flood barrier to form a water seal. In FIG. 14 a four inch wide water seal area is formed. Similarly, the example in FIG. 15 shows the details of forming a water seal between a mounting and mounted steel flood barriers with rear braces using a linear compression gasket as described above.

Figure 16:
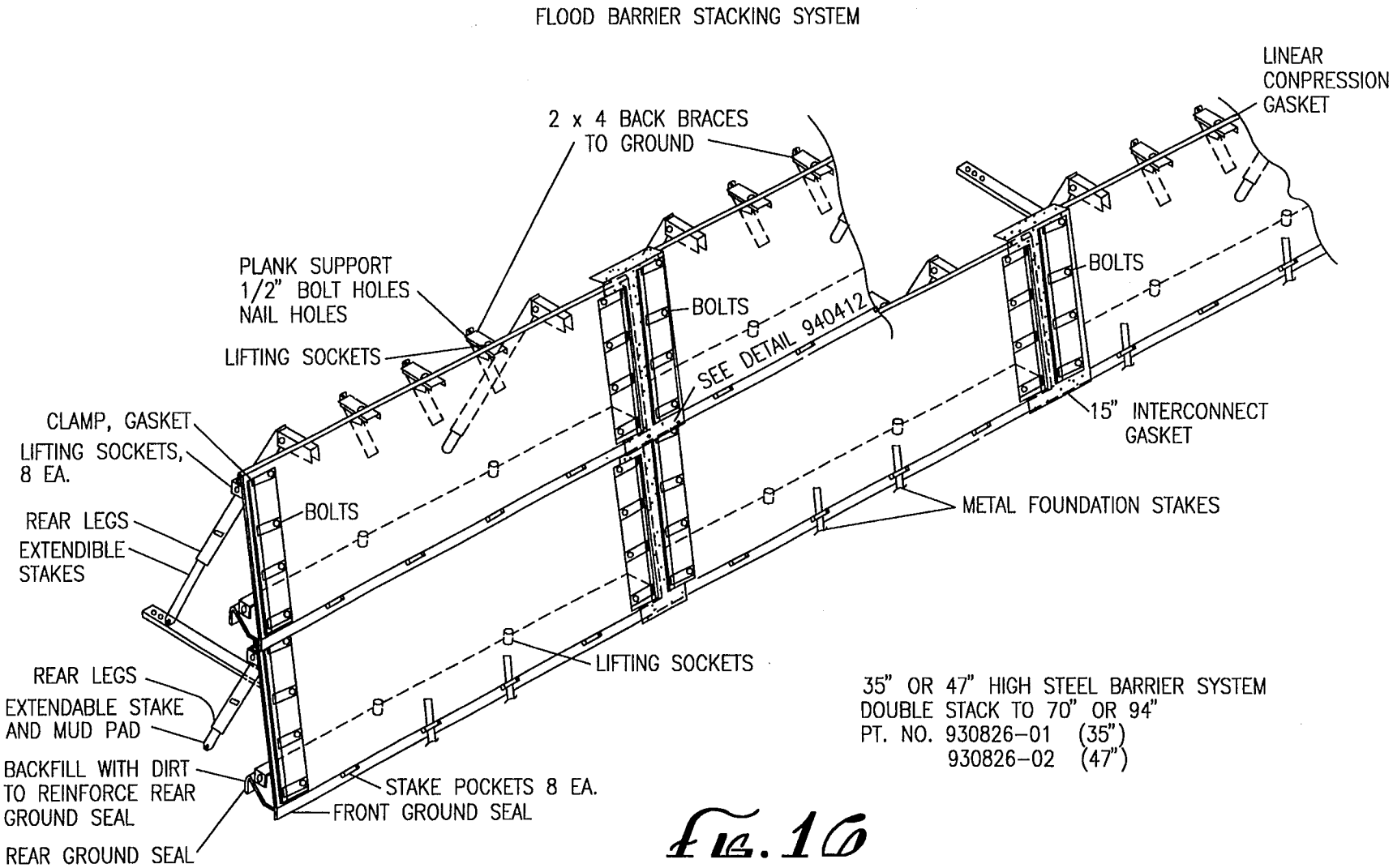
FIG. 16 is a perspective view of an example flood barrier bank 70 inches or 94 inches high and erected from stacked 35 inch or 47 inch steel flood barriers, respectively, according to the present invention.

FIG. 16 shows 35 inch or 47 inch steel flood barriers stacked to form a flood barrier bank 70 inches or 94 inches high, respectively. The flood barriers have rear telescopic support legs. The base of the front panel of each mounting flood barrier is placed on the top edge of the front panel of each mounted flood barrier. The rear support legs of each mounting flood barrier are placed on stacking supports of each mounted flood barrier. Adjacent flood barriers in each row are interconnected with 15 inch wide interconnection gaskets. The water seal area is formed between each mounting and mounted flood barrier as shown in the example in FIG. 15.

Figure 17:
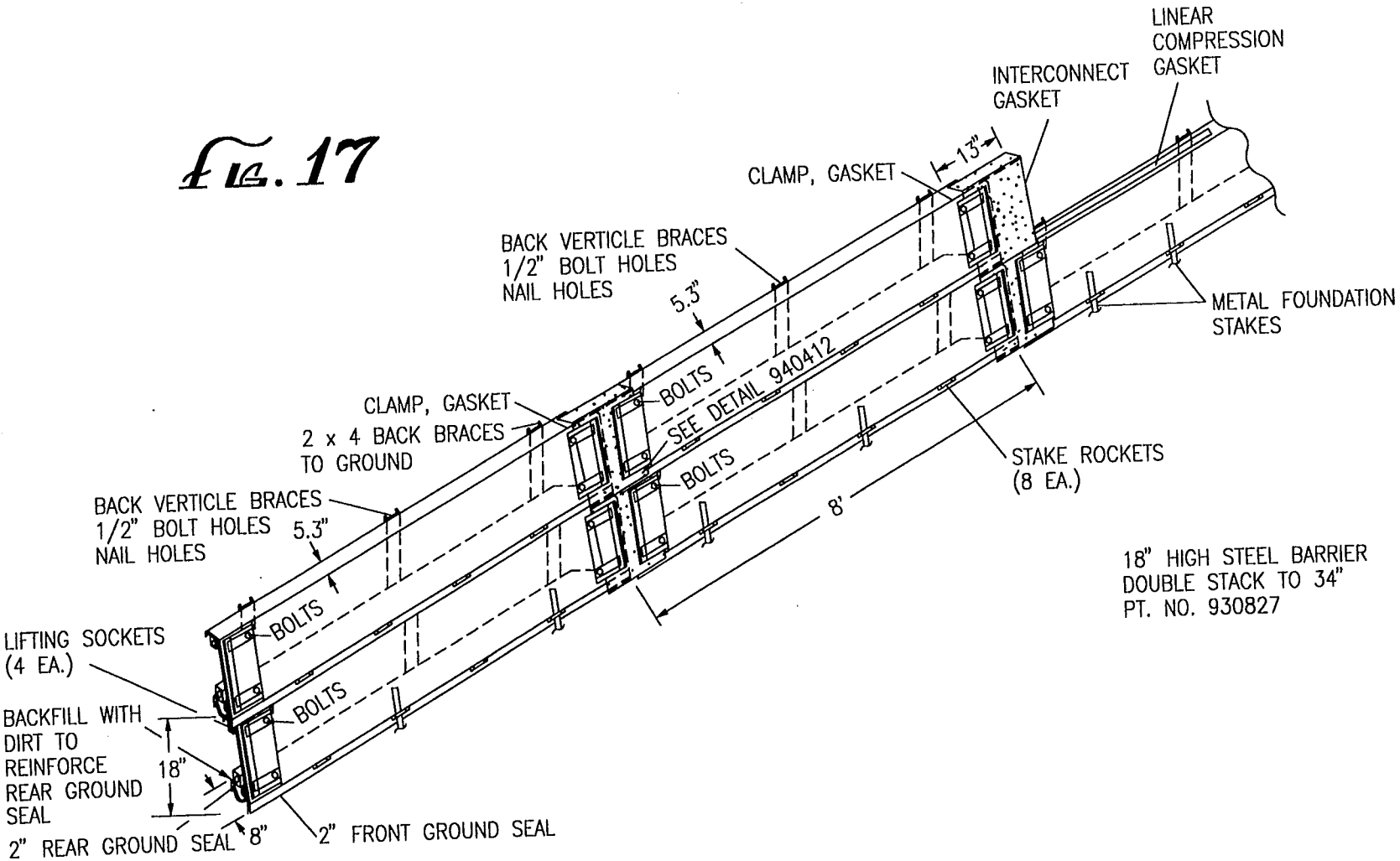
FIG. 17 is a perspective view of an example flood barrier bank 34 inches high and erected from stacked 18 inch high steel flood barriers according to the present invention.
Figure 18:
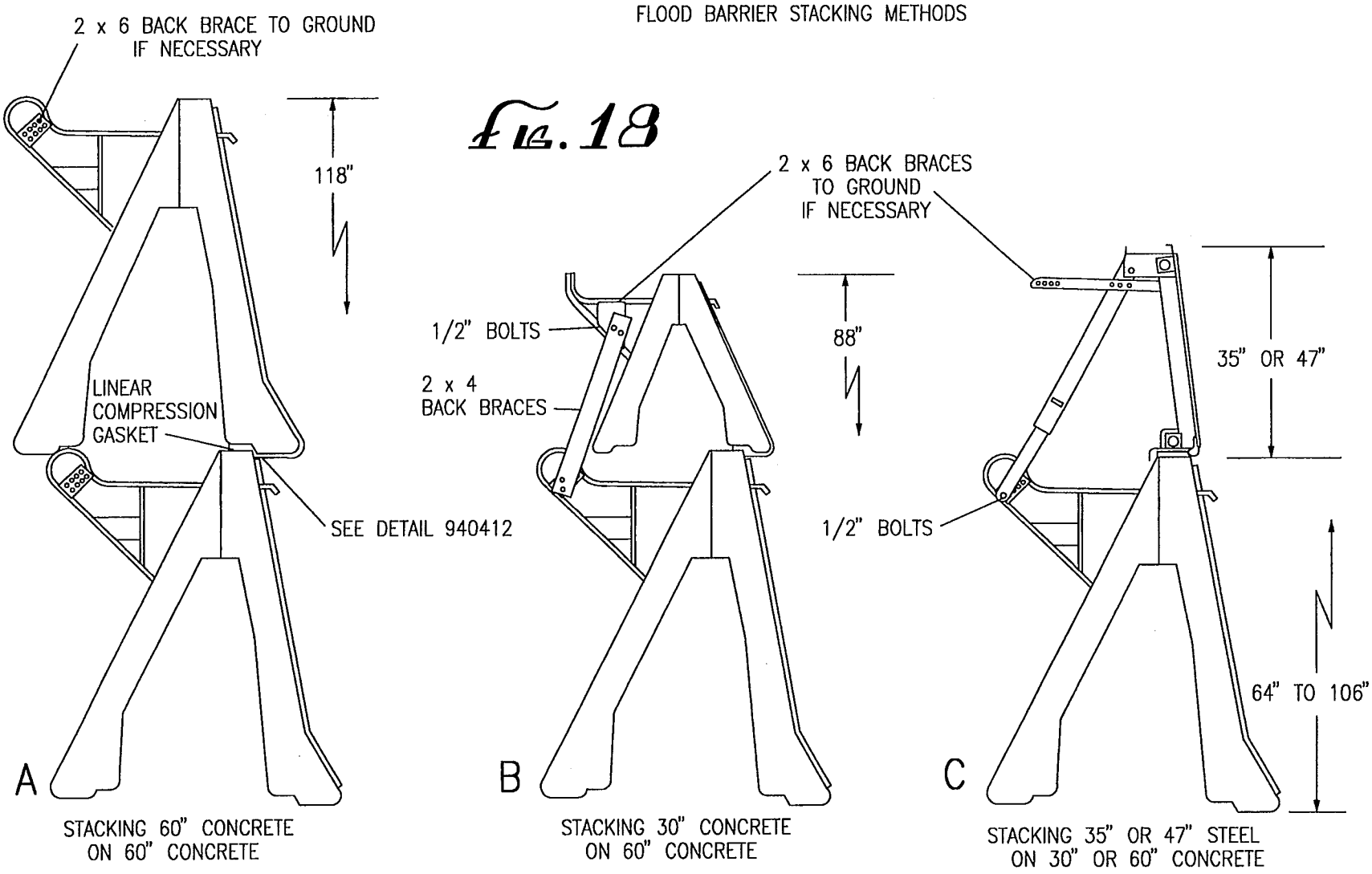
FIG. 18 is a side elevation view of example stacking methods according to the present invention for stacking (a) 60 inch high concrete flood barriers, (b) 30 inch high concrete flood barriers on 60 inch high concrete flood barriers, and (c) 35 inch or 47 inch high steel flood barriers on 30 inch or 60 inch high concrete flood barriers, respectively.
Figure 19:
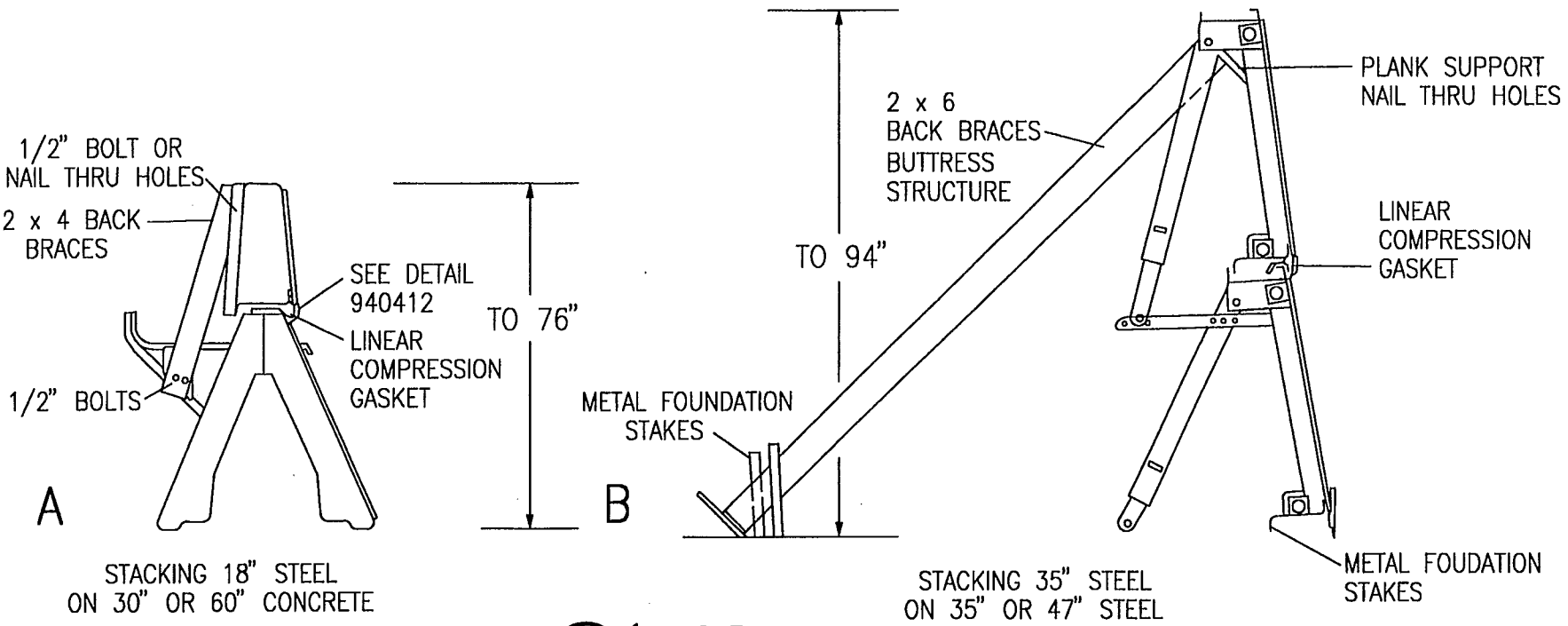
FIG. 19 is a side elevation view of example stacking methods according to the present invention for stacking (a) 18 inch high steel flood barriers on 30 inch or 60 inch high concrete flood barriers, and (b) 35 inch high steel flood barrier on 35 inch or 47 inch steel flood barriers.

Referring to the example flood barrier in FIG. 17, 18 inch high steel flood barriers are used to erect a stacking flood barrier bank 34 inches high. The base of the front panel of the mounting flood barriers are placed on the top edge of the front panel of the mounted flood barriers. 15 inch wide interconnection gaskets are used to interconnect adjacent flood barriers in each row. The steel flood barriers shown in FIG. 14 utilize back vertical braces to buttress the panels on the base. The ends of the vertical braces of the mounting and the mounted flood barriers are planted in the ground. A linear compression gasket is disposed in between the mounting and the mounted flood barriers to form a water seal between the flood barriers as shown in FIG. 15 and described above. Referring to examples in FIGS. 18 and 19, several stacking methods for different flood barriers are shown. Specifically, FIG. 18*a* shows stacking a 60 inch high concrete flood barrier on another 60 inch high concrete flood barrier. FIG. 18*b* shows stacking a 30 inch high concrete flood barrier on a 60 inch high concrete flood barrier. FIG. 18*c* shows stacking a 35 inch or 47 inch steel flood barrier on a 30 inch or 60 inch concrete flood barrier. FIG. 19*a* shows stacking an 18 inch steel flood barrier on a 30 inch or 60 inch concrete flood barrier. FIG. 19*b* shows stacking a 35 inch steel flood barrier on a 35 inch or 47 inch steel flood barrier.

The interconnection gaskets allow a significant vertical or horizontal misalignment between flood barriers of the invention. This allows for terrain variations and latitude to turn corners with the barriers.

Figure 20:
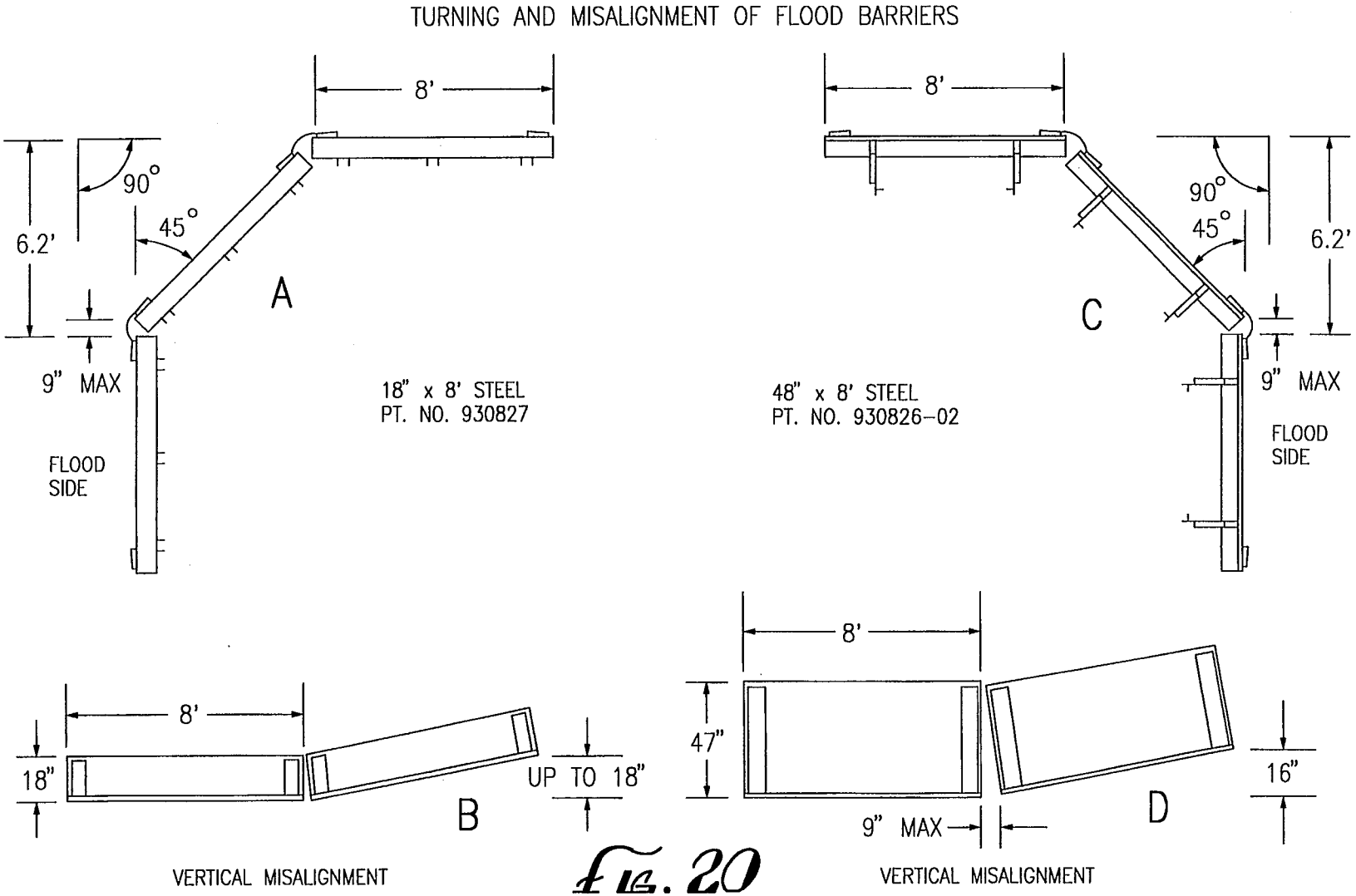
FIG. 20 shows top and front views of example turning and misalignment of steel flood barriers, respectively, in a flood barrier bank according to the present invention.
Figure 21:
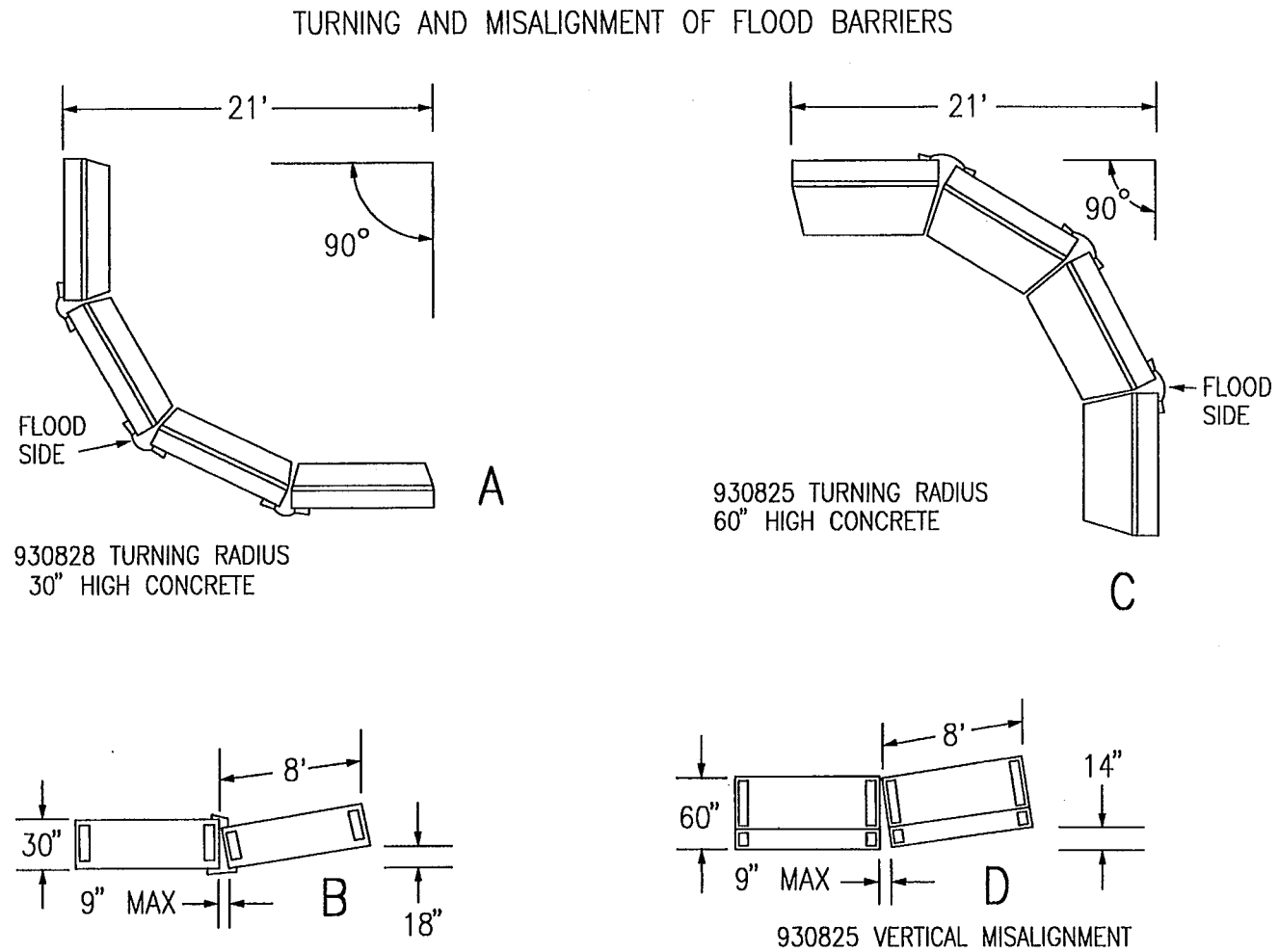
FIG. 21 shows top and front views of example turning and misalignment of concrete flood barriers, respectively, in a flood barrier bank according to the present invention.

FIG. 20 shows an examples of turning and misalignment of steel flood barriers in a flood barrier bank according to the present invention. Specifically FIG. 20*a* is a top view of a turning flood barrier erected from 18 inch high and 8 foot long steel flood barriers. FIG. 20*b* shows a front view of the allowable vertical misalignment of adjacent steel flood barriers wherein each flood barrier is 18 inches high and 8 feet long. FIG. 20*c* shows a turning flood barrier bank erected from 48 inch high and 8 feet long steel flood barriers. FIG. 20*d* is a front view of the allowable vertical misalignment of adjacent steel flood barriers, wherein each flood barrier is 47 inches high and 8 feet long.

FIG. 21*a* is a top view of an example turning flood barrier bank erected from 30 inch high and 8 feet long concrete flood barriers according to the present invention. FIG. 21*b* is a front view of the allowable vertical misalignment between adjacent concrete flood barriers wherein each flood barrier is 30 inches high and 8 feet long. FIG. 21*c* shows the top view of the turning flood barrier bank directed from 60 inch high and 8 feet long concrete flood barriers. FIG. 21*d* shows the frontal view of the allowable vertical misalignment for adjacent concrete flood barriers, wherein each flood barrier is 60 inches high and 8 feet long.

Figure 22:
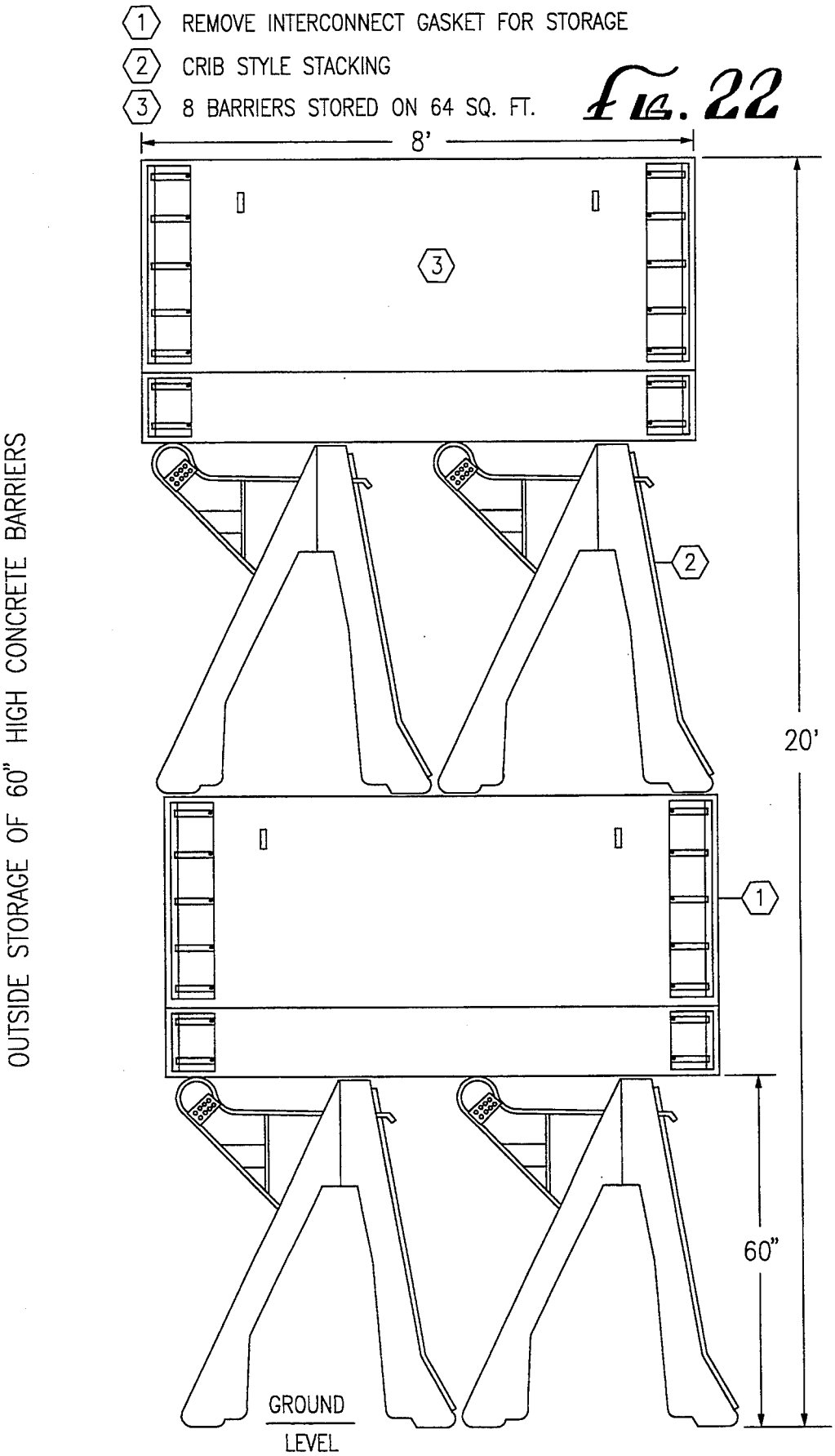
FIG. 22 is a side view of example storage method of 60 inch high and 8 feet long concrete flood barriers according to the present invention.
Figure 23:
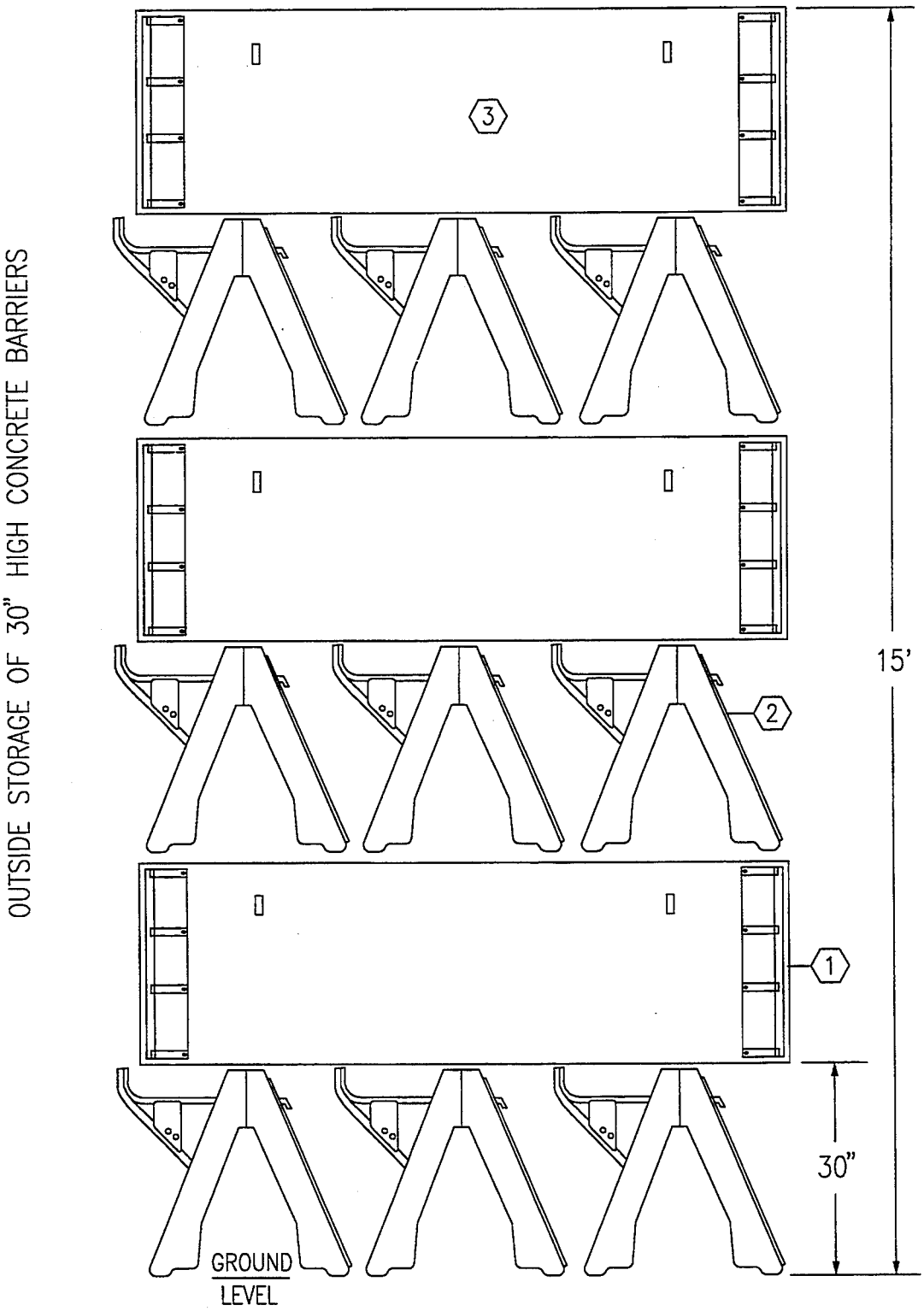
FIG. 23 is a side view of example storage method of 30 inch high and 8 feet long concrete flood barriers according to the present invention.
Figure 24:
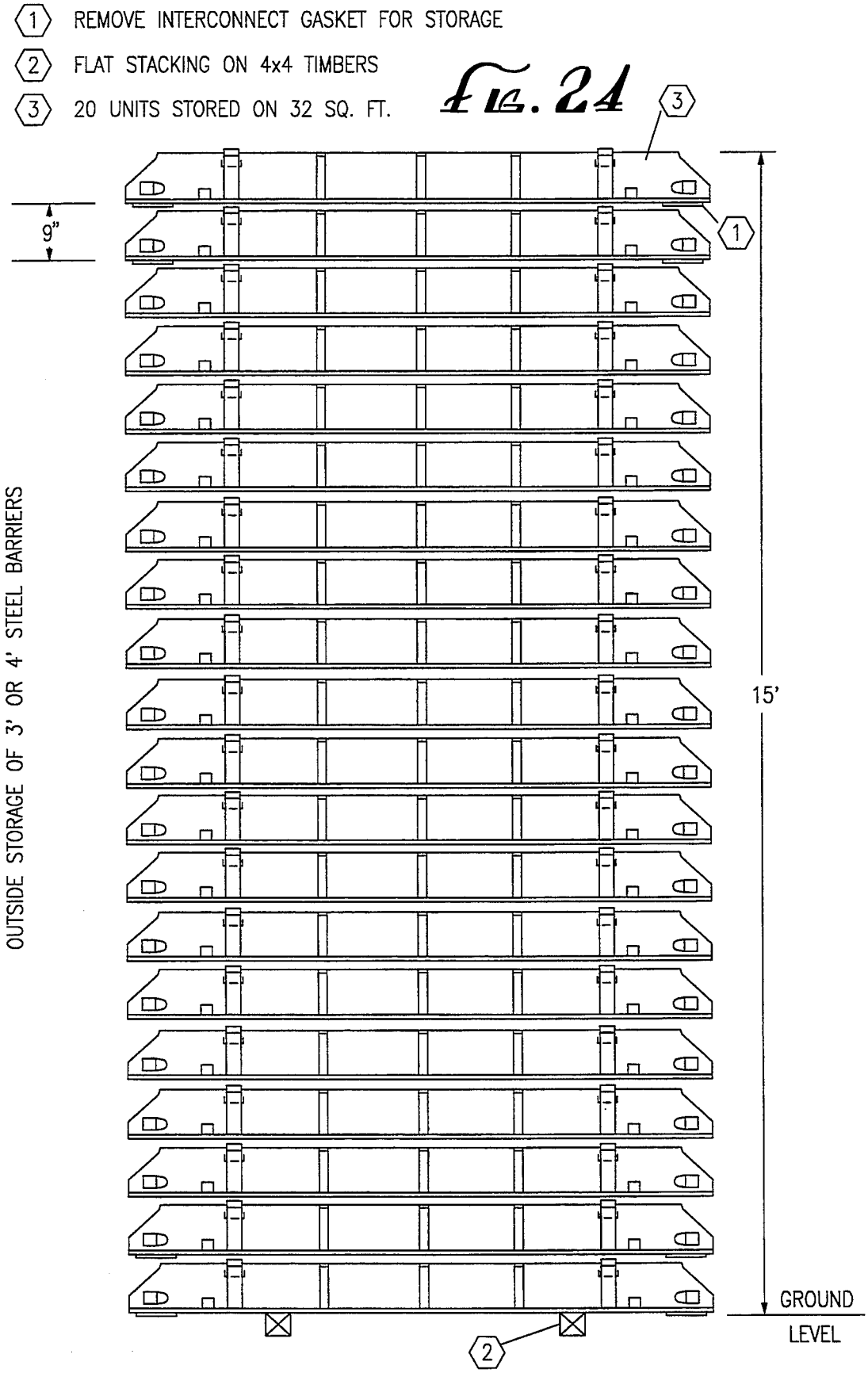
FIG. 24 is a side view of example storage method of three or four feet high and 8 feet long steel flood barriers according to the present invention.
Figure 25:
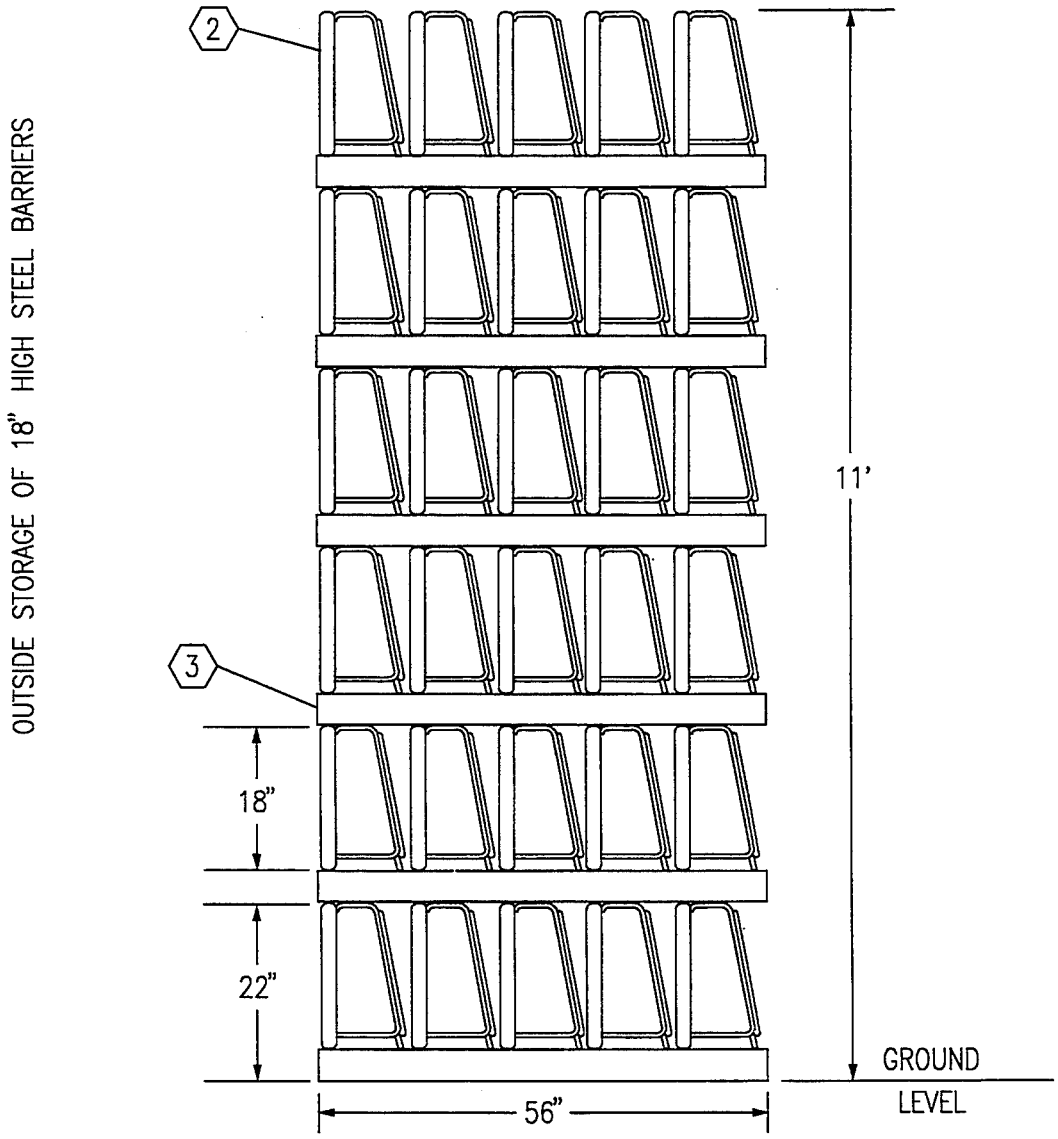
FIG. 25 is a side view of example storage method of 18 inch high and 8 feet long steel flood barriers according to the present invention.

FIG. 22 shows an example of storing 60 inch high and 8 feet long concrete flood barriers. FIG. 23 shows an example of storing 30 inch high and 8 feet long concrete flood barriers. FIG. 24 shows an example of storing three or four feet high and 8 feet long steel flood barriers. FIG. 25 shows storing 18 inch high and 8 feet long steel flood barriers.

The examples described above are only a few of many other examples according to the present invention. It is to be understood that the present invention is not limited to the above examples, and that one skilled in the art would readily understand how to modify the disclosed examples to obtain equivalent results without departing from the spirit and scope of the present invention.

What is claimed is:

1. A portable flood barrier comprising:

(a) a front panel having a front face, a rear face, a top edge, a pair of side edges, and a base;

(b) a rear support attached to the rear face of the front panel to prop the front panel on the base;

(c) at least one stacking support affixed to the rear face of the front panel to allow stacking a portion of a second flood barrier on top of said flood barrier to form a higher flood barrier bank, the front panel of the second flood barrier being disposed in parallel with the front panel of said flood barrier so as to substantially seal their interface; and (d) an elongated clamp removably and adjustably affixed to the front face of the front panel, the clamp having an edge disposed proximate and substantially parallel to each side edge of the front panel respectively, wherein the clamp is capable of anchoring a long edge of an elongated interconnection gasket, the gasket being capable of placement over the gap between a side edge of the front panel of a first flood barrier and an abutting side edge of the front panel of an adjacent second flood barrier to provide a water seal between the front panels.

2. The flood barrier of claim 1 wherein the rear support comprises a rear panel having a top edge, side edges, and a base, the top edge of the rear panel being affixed to the rear face of the front panel such that the rear panel is transverse to the front panel, the top edge of the rear panel being substantially parallel to the top edge of the front panel, and the side edges of the rear panel not extending beyond the side edges of the front panel.

3. The flood barrier of claim 2 further comprising at least one stacking support affixed to the rear face of the front panel to allow stacking a portion of a second flood barrier on top of said flood barrier to form a higher flood barrier bank, the front panel of the second flood barrier being disposed in parallel with the front panel of said flood barrier so as to substantially seal their interface.

4. The flood barrier of claim 1 wherein the stacking support comprises an arm affixed to the rear face of the front panel proximate the top edge of the front panel, and wherein the arm is capable of supporting a portion of a second flood barrier stacked on top of said flood barrier.

5. The flood barrier of claim 4 wherein the arm is capable of supporting a portion of a second flood barrier comprising (a) a front panel having a front face, a rear face, a pair of side edges, and a base, and (b) a rear support affixed to the rear face of the front panel comprising a rear panel to prop the front panel on the base, the rear panel having a top edge, side edges, and a base, the top edge of the rear panel being affixed to the rear face of the front panel such that the rear panel is transverse to the front panel, the top edge of the rear panel being substantially parallel to the top edge of the front panel, and the side edges of the rear panel not extending beyond the side edges of the front panel.

6. The flood barrier of claim 4 wherein the arm is capable of supporting a portion of a second flood barrier comprising (a) a front panel having a front face, a rear face, a pair of side edges, and a base, and (b) a rear support affixed to the rear face of the front panel, the rear support comprising at least one elongated telescopic leg having a top end and a base end wherein the top end of the leg is affixed to the rear face of the front panel proximate the top edge of the front panel.

7. A portable flood barrier comprising:

(a) a front panel having a front face, a rear face, a top edge, a pair of side edges, and a base;

(b) a rear support attached to the rear face of the front panel to prop the front panel on the base; and (c) an elongated clamp removably and adjustably affixed to the front face of the front panel, the clamp having an edge disposed proximate and substantially parallel to each side edge of the front panel respectively, wherein the clamp is capable of anchoring a long edge of an elongated interconnection gasket, the gasket being capable of placement over the gap between a side edge of the front panel of a first flood barrier and an abutting side edge of the front panel of an adjacent second flood barrier to provide a water seal between the front panels, wherein the front face and the rear face of the front panel comprise at least one stake pocket respectively, each stake pocket being capable of receiving a foundation stake protruding into the stake pocket uprightly, the flood barrier further comprising at least two foundation stakes capable of being planted in the ground, whereby the front panel can be disposed in the base with each foundation stake introduced into a respective stake pocket, and wherein the rear support comprises at least one elongated rear vertical capable of being planted in the ground, whereby the front panel can be supported on the base with the rear vertical brace abutting the rear face of the front panel.

8. The flood barrier of claim 7 further comprising at least one stacking support affixed to the rear face of the front panel to allow stacking a portion of a second flood barrier on top of said flood barrier to form a higher flood barrier bank, the front panel of the second flood barrier being disposed in parallel with the front panel of said flood barrier so as to substantially seal their interface.

9. The flood barrier of claim 7 wherein the rear support comprises an elongated telescopic leg having a top end and a base end, the top end of the leg being affixed to the rear face of the front panel proximate the top edge of the front panel.

10. The flood barrier of claim 9 further comprising at least one stacking support affixed to the rear face of the front panel to allow stacking a portion of a second flood barrier on top of said flood barrier to form a higher flood barrier bank, the front panel of the second flood barrier being disposed in parallel with the front panel of said flood barrier so as to substantially seal their interface.

11. The flood barrier of claim 1 wherein the front face of the front panel comprises at least one stake pocket being capable of receiving a foundation stake protruding into the stake pocket uprightly, the flood barrier further comprising at least one foundation stake capable of being planted in the ground, whereby the front panel can be disposed on the base with the foundation stake introduced into the stake pocket, and wherein the rear support comprises at least one elongated rear vertical capable of being planted in the ground, whereby the front panel can be supported on the base with the rear vertical brace abutting the rear face of the front panel.

12. The flood barrier of claim 1 wherein the rear face of the front panel comprises at least one stake pocket being capable of receiving a foundation stake protruding into the stake pocket uprightly, the flood barrier further comprising at least one foundation stake capable of being planted in the ground, whereby the front panel can be disposed on the base with the foundation stake introduced into the stake pocket, and wherein the rear support comprises at least one elongated rear vertical capable of being planted in the ground, whereby the front panel can be supported on the base with the rear vertical brace abutting the rear face of the front panel.

13. A portable flood barrier comprising:

(a) a front panel having a front face, a rear face, a top edge, a pair of side edges, and a base;

(b) a rear support attached to the rear face of the front panel to prop the front panel on the base, the rear support comprising a rear panel having a top edge, side edges, and a base, the top edge of the rear panel being affixed to the rear face of the front panel such that the rear panel is transverse to the front panel, the top edge of the rear panel being substantially parallel to the top edge of the front panel, and the side edges of the rear panel not extending beyond the side edges of the front panel;

(c) an elongated clamp removably and adjustably affixed to the front face of the front panel, the clamp having an edge disposed proximate and substantially parallel to each side edge of the front panel respectively, wherein the clamp is capable of anchoring a long edge of an elongated interconnection gasket, the gasket being capable of placement over the gap between a side edge of the front panel of a first flood barrier and an abutting side edge of the front panel of an adjacent second flood barrier, wherein the anchoring action of the clamp on adjacent flood barrier front panels enables the gasket to provide a water seal between the front panels; and (d) at least one stacking support affixed to the rear face of the front panel to allow stacking a portion of a second flood barrier on top of said flood barrier to form a higher flood barrier bank, the stacking support comprising an arm affixed to the rear face of the front panel proximate the top edge of the front panel, wherein the front panel of the second flood barrier is disposed in parallel with the front panel of said flood barrier so as to substantially seal their interface.

14. A flood barrier bank comprising:

(a) a plurality of flood barriers located side-by-side in substantially horizontal alignment, each flood barrier comprising:

(i) a front panel having a front face, a rear face, a top edge, pair of side edges, and a base;

(ii) at least one rear support affixed to the rear face of the front panel to prop the panel on the base;

(iii) an elongated clamp removably and adjustably affixed to the front face of the front panel, the clamp having an edge disposed proximate and substantially parallel to each side edge of the front panel respectively, wherein the clamp is capable of anchoring a long edge of an elongated interconnection gasket, the gasket being capable of placement over the gap between a side edge of the front panel of a first flood barrier and an abutting side edge of the front panel of an adjacent second flood barrier, wherein the anchoring action of the clamp on adjacent flood barrier front panels enables the gasket to provide a water seal between the front panel; and (b) a plurality of elongated interconnection gaskets placed over the gap between a side edge of the front panel of a first flood barrier and an abutting side edge of the front panel of an adjacent second flood barrier to provide a water seal between the front panels of the adjacent flood barriers;

wherein:

(i) the front face and the rear face of the panel of each flood barrier comprises at least one stake pocket respectively, each stake pocket being capable of receiving a foundation stake protruding into the stake pocket uprightly, (ii) each flood barrier further comprises at least two foundation stakes capable of being planted in the ground, whereby the front panel of said flood barrier can be disposed on the base of said front panel with each foundation stake introduced into a respective stake pocket in, and (iii) the rear support of each flood barrier comprises at least one elongated rear vertical brace capable of being planted in the ground, whereby the front panel of said flood barrier can be supported on the base of said front panel with the rear vertical brace abutting the rear face of said front panel.

15. A method of erecting a flood barrier bank, the method comprising the steps of:

(a) disposing a set of flood barriers side-by-side in substantially horizontal alignment, each flood barrier comprising:

(i) a front panel having a front face, a rear face, a top edge, a pair of side edges, and a base;

(ii) a rear support attached to the rear face of the front panel to prop the front panel on the base;

(iii) an elongated clamp removably and adjustably affixed to the front face of the front panel, the clamp having an edge disposed proximate and substantially parallel to each side edge of the front panel respectively, wherein the clamp is capable of anchoring a long edge of an elongated interconnection gasket, the gasket being capable of placement over the gap between a side edge of the front panel of a first flood barrier and an abutting side edge of the front panel of an adjacent second flood barrier, wherein the anchoring action of the clamp on adjacent flood barrier front panels enables the gasket to provide a water seal between the front panels;

(b) for each pair of adjacent flood barriers (i) placing an elongated interconnection gasket over the gap between a side edge of the front panel of one flood barrier and an abutting side edge of the front panel of the other flood barrier, and (ii) anchoring the interconnection gasket via the clamps on the flood barriers so as to provide a water seal between the front panels of the interconnected flood barriers;

(c) disposing another set of flood barriers each comprising a front panel and pair of side edges by stacking the flood barriers side-by-side in substantially horizontal alignment on top of an interconnected set of flood barriers, the front panel of each mounting flood barrier being disposed in parallel with the front panel of a corresponding mounted flood barrier so as to substantially seal their interface;

(d) for each pair of stacked adjacent flood barriers by (i) placing an elongated interconnection gasket over the gap between a side edge of the front panel of one flood barrier and an abutting side edge of the front panel of the other flood barrier, and (ii) anchoring the interconnection gasket via clamps on the flood barriers so as to provide a water seal between the front panels of the flood barriers; and (e) repeating steps (c) and (d) until a desired flood bank height is reached.

* * * * *